US005493871A

United States Patent [19]

Eiermann

[11] Patent Number: 5,493,871

[45] Date of Patent: Feb. 27, 1996

[54] METHOD AND APPARATUS FOR LATENT HEAT EXTRACTION

[76] Inventor: Kenneth L. Eiermann, 1049 Manchester Cir., Winter Park, Fla. 32792

[21] Appl. No.: 290,202

[22] Filed: Aug. 15, 1994

Related U.S. Application Data

[63] Continuation-in-part of Ser. No. 8,192, Jan. 25, 1993, Pat. No. 5,337,577, which is a continuation of Ser. No. 791,120, Nov. 12, 1991, Pat. No. 5,181,552.

[51] Int. Cl.[6] ..... F25D 17/06

[52] U.S. Cl. ..... 62/173; 62/90

[58] Field of Search ..... 62/90, 173, 176.5

[56] References Cited

U.S. PATENT DOCUMENTS

| | | | |
|---|---|---|---|
| 1,837,798 | 12/1993 | Shipley | 62/90 X |
| 2,200,118 | 5/1940 | Miller | 62/173 |
| 2,438,120 | 3/1948 | Freygang | 62/90 |
| 2,715,320 | 8/1955 | Wright | 62/176.5 |
| 4,271,678 | 6/1981 | Liebert | 62/173 |
| 4,658,594 | 4/1987 | Langford | 62/176.5 |
| 5,193,352 | 3/1993 | Smith et al. | 62/90 |

FOREIGN PATENT DOCUMENTS 3415000 10/1985 Germany .

*Primary Examiner*—William E. Wayner

*Attorney, Agent, or Firm*—Fay, Sharpe, Beall, Fagan, Minnich & McKee

[57] ABSTRACT

A method and apparatus for improved latent heat extraction combines a run-around coil system with a condenser heat recovery system to enhance the moisture removing capability of a conventional vapor compression air conditioning unit. The run-around coil system exchanges energy between the return and supply air flows of the air conditioning unit. Energy recovered in the condenser heat recovery system is selectively combined with the run-around system energy extracted from the return air flow to reheat the supply air stream for downstream humidity control. A control system regulates the relative proportions of the extracted return air flow energy and recovered heat energy delivered to the reheat coil for efficient control over moisture in the supply air flow. Auxiliary energy in the form of electric heat energy is further added to the recovered heat energy for additional reheat use. In water cooled condenser unit systems, the cooling medium is shared and selectively exchanged between the air conditioning system and the run-around coil system. In another mode, a chiller/heater interfaces a chilled water circulating loop with a hot water circulating loop including a run-around coil system.

14 Claims, 17 Drawing Sheets

SEA LEVEL PSYCHROMETRIC CHART

PROTRACTOR $$\frac{\text{SENSIBLE HEAT}}{\text{TOTAL HEAT}}$$

METHOD AND APPARATUS FOR LATENT HEAT EXTRACTION

CROSS REFERENCE TO RELATED APPLICATIONS

This application is a continuation-in-part application of application Ser. No. 08/008,192 filed Jan. 25, 1993, now U.S. Pat. No. 5,337,577, which was a continuation of application Ser. No. 07/791,120 filed Nov. 12, 1991, now U.S. Pat. No. 5,181,552.

BACKGROUND OF THE INVENTION

This application pertains to the art of air conditioning methods and apparatus. More particularly, this application pertains to methods and apparatus for efficient control of the moisture content of an air stream which has undergone a cooling process as by flowing through an air conditioning cooling coil or the like. The invention is specifically applicable to dehumidification of a supply air flow into the occupied space of commercial or residential structures. By means of selective combination of extracted return air flow heat energy and recovered refrigerant waste heat energy, the supply air flow is warmed using a reheat coil apparatus. The return air flow entering the air conditioning coil is precooled with a precooling coil in operative fluid communication with the reheat coil. Heating of the occupied space may be effected using the combined reheat and precooling coils in conjunction with an alternative heat source such as electric, solar, or the like and will be described with particular reference thereto. It will be appreciated, though, that the invention has other and broader applications such as cyclic heating applications wherein a supply air flow is heated at the reheat coil irrespective of the instantaneous operational mode of the refrigerant system through the expedient of a thermal energy storage tank or the like.

Conventional air conditioning systems use a vapor compression refrigeration cycle that operates to cool an indoor air stream through the action of heat transfer as the air stream comes in close contact with evaporator type or flooded coil type refrigerant-to-air heat exchangers or coils. Cooling is accomplished by a reduction of temperature as an air stream passes through the cooling coil. This process is commonly referred to as sensible heat removal. A corresponding simultaneous reduction in the moisture content of the air stream typically also occurs to some extent and is known as latent heat removal or more generally called dehumidification. Usually the cooling itself is controlled by means of a thermostat or other apparatus in the occupied space which respond to changes in dry bulb temperature. When controlled in this manner, dehumidification occurs as a secondary effect incidental to the cooling process itself. As such, dehumidification of the indoor air occurs only when there is a demand for reduced temperature as dictated by the thermostat.

To accomplish dehumidification when the thermostat does not indicate a need for cooling, a humidistat is often added to actuate the air conditioning unit in order to remove moisture from the cooled air stream as a "byproduct" function of the cooling. In this mode of operation, heat must be selectively added to the cooled air stream to prevent the conditioned space from over-cooling below the dry bulb set point temperature. This practice is commonly known as "reheat".

Many sources of heat have been used for reheat purposes, such as hydronic hot water with various fuel sources, hydronic heat recovery-sources, gas heat, hot gas or hot liquid refrigerant heat, and electric heat. Electric heat is most often used because it is usually the least expensive alternative overall. However, the use of electric heat to provide the reheat energy is proscribed by law in some states, including Florida for example.

In order to conserve energy, it has been suggested that recovered heat be used as a source for the reheat. Accordingly, one method to improve the moisture removal capacity of an air conditioning unit, while simultaneously providing reheat, is to provide two heat exchange surfaces each in one of the air streams entering or leaving the cooling coil while circulating a working fluid between the two heat exchangers. This type of simple system is commonly called a run-around system.

Run around systems have met with limited success. The working fluid is cooled in a first heat exchange surface placed in the supply air stream called a reheat coil. The cooled working fluid is then in turn caused to circulate through a second heat exchange surface placed in the return air stream called a precooling coil. This simple closed loop circuit comprises the typical run-around systems available heretofore.

The precooling coil serves to precool the return air flow prior to its entering the air conditioning cooling coil itself. The air conditioning coil then provides more of its cooling capacity for the removal of moisture from the air stream otherwise used for sensible cooling. However, the amount of reheat energy available in this process is approximately equal to the amount of precooling accomplished. This is a serious constraint. Additional reheat energy is often needed for injection into the run-around system to maintain the desired dry bulb set point temperature and humidity level in the conditioned space. As described above, supplemental electric reheat has been used with some success.

In addition, the growth of molds in low velocity air conditioning duct systems has recently become a major indoor air quality concern. One of the control measures recognized as having the capability of limiting this undesirable growth is the maintenance of the relative humidity at 70 percent or lower in the air conditioning system air plenums and ducts. Within limits, reheat can be used to precisely control the relative humidity. However, as described above, the amount of reheat energy from the run-around systems available today may not be sufficient to consistently provide the above level of humidity control, particularly during periods of operation when the air temperature entering the precooling coil is lower than the system design operating temperature.

As a further complication, air conditioning units are also often used for heating purposes as well as for cooling and dehumidification. Electric heating elements are often provided in the air conditioning units to selectively provide the desired amount of heat at precise times of the heating demand. The above demand for heating energy will most often correspond with the demand for heating at other air conditioning units in the locality. This places a substantial and noticeable demand on the electrical power utility system in the community. In many areas, this peak demand has exceeded the capacity of the power system. The electric utility companies have responded with incentives encouraging their customers to temper their demand during regional peak demand periods. These incentives are often in the form of demand charges which encourage the customer to reduce their demand on the system at those times in order to avoid incremental costs in addition to the regular base rates.

It has, therefore, been deemed desirable to provide an economical solution that meets the various needs of air conditioning system installation requirements while also operating in compliance with current and projected local environmental and energy-related laws.

SUMMARY OF THE INVENTION

This invention improves the dehumidification capabilities of conventional air conditioning systems through the addition of a run-around system having a supplemental heat energy source for reheat use. The amount of reheat energy that can be incrementally added to the stream air leaving the conditioning unit is thereby increased. An air conditioning unit so configured is capable of operating continuously over a wide range of conditions for providing dehumidification to the occupied space independent of the sensible cooling demand at the conditioned space. Such a system is further capable of maintaining a precise relative humidity level in the air conditioning duct system to enhance the indoor air quality of the occupied conditioned space. Further, the overall system may be used to heat the occupied space through the expedient of the stored energy scheme according to the teachings of the preferred embodiments.

In the preferred embodiment, the supplemental heat source is heat recovered from the refrigeration process of the particular installed air conditioning system having the reheat requirement. In another embodiment, the supplemental heat is an alternative energy source, such as a gas or electric boiler, or water heater. The new energy source may be of particular benefit for use with an air conditioning system that uses chilled water or cold brine for the cooling medium.

The basic preferred embodiment of the invention comprises heat exchange coils in the entering air stream and leaving air stream of an air conditioning unit primary cooling coil. The basic preferred embodiment further comprises a circulating pump, and a supplementary heat source, which can be a heat recovery device on the air conditioning unit refrigeration circuit or a conventional liquid heater or the like.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
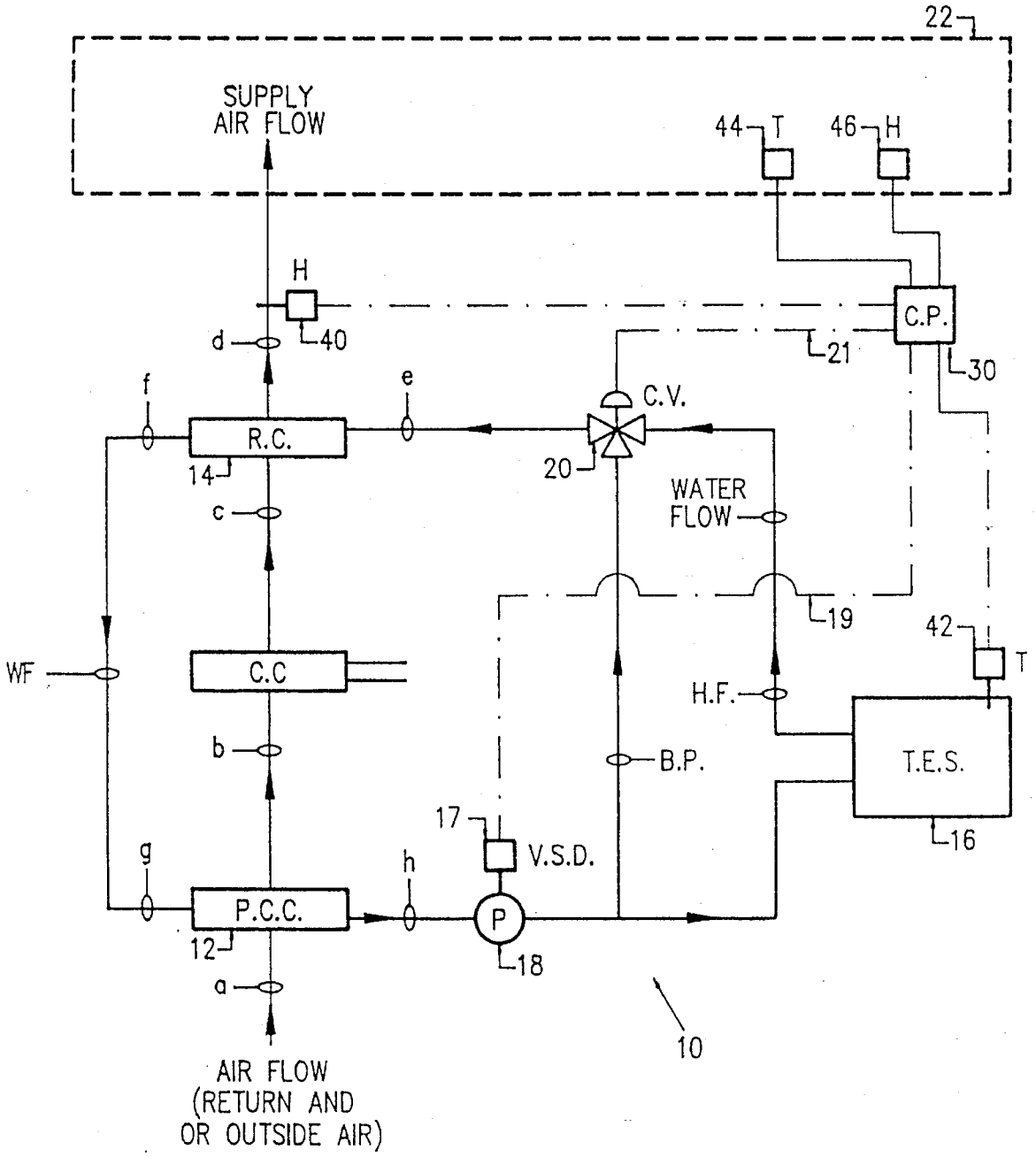
FIG. 1 illustrates a schematic view of a first preferred embodiment of the apparatus for latent heat extraction according to the invention.

Referring now to the drawings wherein showings are for purposes of illustrating the preferred embodiments of the invention only and not for purposes of limiting same, the FIGURES show a moisture control apparatus 10 for conditioning the air in an occupied space 22. The apparatus 10 comprises suitably arranged components including a precooling coil 12 in a return air flow a, b, a reheat coil 14 in a supply air flow c, d, a thermal energy storage tank 16 operatively associated with a source of heat, a working fluid pump 18 for circulating a working fluid through an arrangement of the above coils and tank, a pump drive 17 for controlling the operation of the fluid pump 18 and a control valve 20 for metering the working fluid. An apparatus controller 30 generates a control valve signal for control of the valve 20 and generates pump command signals for control over the working fluid pump 18 to effect a working fluid flow.

With particular reference to FIG. 1, the working fluid includes a coil flow CF, a bypass fluid flow BP, and a heated fluid flow HF. The coil flow CF through the reheat and precooling coils 14, 12, enters the control valve 20 from one of two sources including the bypass fluid flow BP and the heated fluid flow HF. The heated fluid flow HF passes first through the thermal energy storage tank 16 during its flow to the valve 20. On the other hand, the bypass fluid flow BP is routed from a "T" coupler 80 directly to the control valve 20 through a bypass conduit 82. The flows of the bypass fluid flow BP and the heated fluid flow HF comprising the working fluid are motivated by the working fluid pump 18 upstream of said coupler 80. A mixture of bypass fluid flow BP and heated fluid flow HF is accomplished using the control valve 20, which is responsive to the controller 30, to selectively meter the relative proportions of the bypass (cooler) and heated (warmer) fluid flows.

The control valve 20 includes two input ports and an output port. A first input port is connected to the bypass conduit 82 for receiving the bypass fluid flow BP, and the second input port is connected to a tank conduit 84 from the thermal energy storage tank 16 for receiving the heated fluid flow HF. The output port is connected to the series arrangement of the reheat coil 14 and the precooling coil 12 for directing and flowing the coil fluid flow CF.

In the first preferred embodiment illustrated, the control valve is a variably adjustable blending valve responsive to an analog signal from the controller 30 for adjusting the relative proportions of the bypass and heated fluid flows over a continuum. As an alternative to the above valve type, the control valve may be a modulated valve responsive to logical signals from the controller 30. In that alternative case, the duty cycles at the input ports control the blending of the heated and bypass fluid flows HF and BP respectively.

Also in the first preferred embodiment illustrated, the pump drive 17 is responsive to an analog pump speed command signal 19 from the controller 30 to variably control the speed of the working fluid pump 18 over a continuous range. As an alternative to the above, the pump and drive may be of a modulated variety responsive to logical signals from the controller 30. In that alternative case, the duty cycle of the waveform from the controller 30 controls the fluid pressure and in turn volume of the working fluid circulated through the apparatus.

With continued reference to FIG. 1, the apparatus controller 30 is an operative communication with a plurality of system input devices, each of which sense various physical environmental conditions. These input devices include a supply airflow humidity sensor 40 for sensing the humidity in the supply airflow, a thermal energy storage tank temperature sensor 42 for sensing the temperature in the thermal energy storage tank, an occupied space dry bulb temperature sensor 44 for sensing the dry bulb temperature in the occupied space, and an occupied space humidity sensor 46 for sensing the humidity in the occupied space. The humidity sensor 40 may be replaced with a temperature sensor for ease of maintenance and reliability or a combination of a temperature sensor and humidity sensor may be used.

In addition, the controller 30 is in operative communication with a plurality of active output devices. The output devices are responsive to signals deriving from the apparatus controller 30 according to programmed control procedures detailed below. In the preferred embodiment, the output devices comprise the control valve 20 responsive to the control valve signal 21, and the variable speed drive 17 responsive to the pump speed command signal 19. Additional input and output signals, including alarm and data logging signals or the like, may be added to the basic system illustrated in FIG. 1 as understood by one skilled in the art after reading and understanding the instant detailed description of the preferred embodiments.

Figure 2:
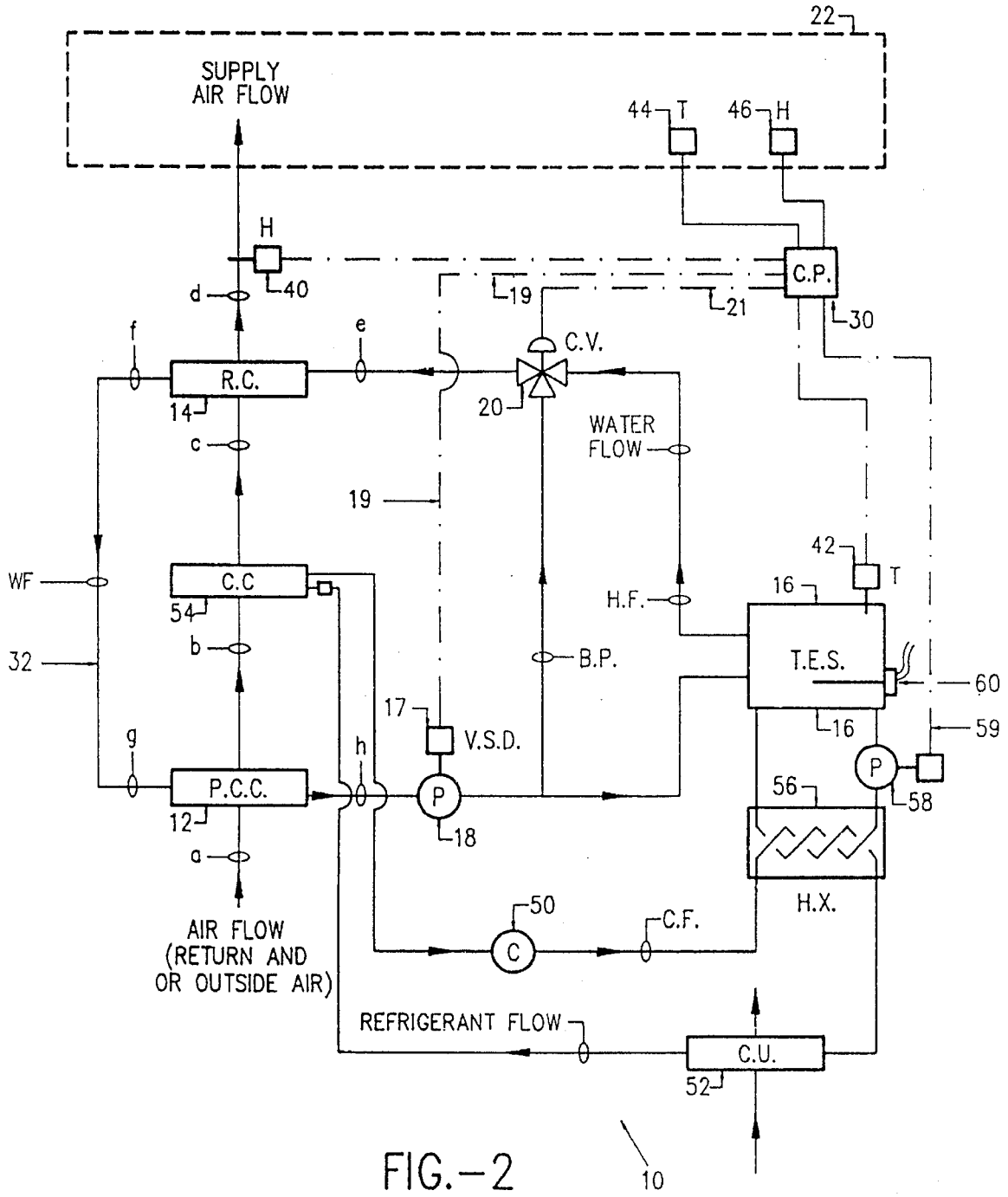
FIG. 2 illustrates a schematic view of the first preferred embodiment of the invention when used with a conventional air conditioning unit having a vapor compression type refrigeration system.

With particular reference now to FIG. 2, a schematic diagram of the first preferred embodiment of the apparatus of the invention is illustrated adapted for use with a conventional air-conditioning unit having a vapor compression type refrigeration system. For ease of illustration and discussion followed below, like elements will be referred to by like numerals with a primed (') and double primed (") suffix, and new elements will be referred to by new numerals. The system includes a compressor 50 for compressing a compressible fluid CF and a condenser coil 52. An evaporative cooling coil 54 absorbs heat from a return air flow a, b resulting in a cooled supply air flow c, d into an occupied space 22. These various air conditioning components may be assembled in a single package, known in the art as a roof-top unit, or may be provided as a system comprising separated items, such as what is called a split system.

With continued reference to FIG. 2, a reheat coil 14, as described above, is placed in the supply air flow c, d after (downstream of) the evaporative cooling coil 54, while a precooling coil 12 is placed in the return air flow a, b before (upstream of) the cooling coil 54. For full effectiveness of the air quality control measure of the instant invention, the reheat coil 14 should be physically mounted as close as possible to the cooling coil 54. The precooling coil 12 can be mounted in any convenient location and may be so situated as to precool only the outside air, only the return air, or a mixture of the outside air and return air (not shown).

As discussed above in connection with FIG. 1, the working fluid pump 18 is connected to a variable speed drive 17 which operates to circulate the working fluid WF between the reheat coil 14, the precooling coil 12, and the thermal energy storage tank 16. In the preferred embodiment, the working fluid is water. In general, the overall system may be used in various operating modes including a space cooling mode, a space dehumidification mode, and a space heating mode. To describe the full operation of the system, each of the operational modes will be described in detail below.

In the space cooling mode, the working fluid pump 18 operates when the refrigeration system compressor 50 is operating. In this mode, the compressor 50 is responsive to the occupied space dry bulb temperature sensor 44. The pump 18 is driven by the variable speed drive 17 which regulates the water flow to maintain the desired humidity setting at the supply air flow humidity sensor 40. Water flow is increased on a rise in the relative humidity above a predetermined set point and conversely decreased on a drop in relative humidity at the supply air flow humidity sensor 40 below said set point.

In the space dehumidification mode, the compressor 50 of the conventional air-conditioning unit is operated to maintain the humidity at the occupied space 22, as sensed by the occupied space humidity sensor 46, the speed of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature. Responsive to command signals from the apparatus controller 30 and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17.

In general terms, cooled air leaving the evaporative type cooling coil 54 enters the reheat coil 14 where it absorbs heat from the working fluid flow in the tubes of the reheat coil itself. There is a drop in heat content of the working fluid from points e to f equal to the rise in the heat content of the air stream from points c to d. The working fluid is transferred through the piping system 32 to the precooling coil 12. Cooled working fluid from the reheat coil 14 absorbs heat from the return air flow stream as the air passes over the precooling coil surfaces. There is a rise in the heat content in the working fluid from points g to h equal to the drop in the heat content of the air stream from points a to b. These principles are each generally well-known and established in the art.

Heat exchange pump 58 operates when the compressor 50 is operating and when the temperature and the thermal energy storage tank 16 is below a predetermined set point at the thermal energy storage tank temperature sensor 42. The function of the heat exchange pump 58 is to transfer working fluid heated by the hot refrigerant gas in a heat exchanger 56. The heat exchange pump 58 stops even though the compressor 50 is running when the temperature in the thermal energy storage tank 16 is at an upper working fluid temperature set point as determined by the thermal energy storage tank temperature sensor 42. The general function of the heat exchanger 56 is to provide supplemental heat to charge the thermal energy storage tank 16 with hot working fluid for heating and/or reheat operation.

An electric heating element 60 may be used as an additional energy source to heat the working fluid when there is a demand for more heat than may be provided by the heat exchanger 56. The supplemental electric heating operation is controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., the heat exchange pump 58 is made to begin operation on a drop in temperature below 120° F. Conversely, when the thermal energy storage tank temperature drops to 120° F., the electric heating element 60 is activated by the apparatus controller 30. On a rise in the thermal energy storage tank temperature, the heating element 60 is first turned off, and on a continued rise in temperature to the 125° F. set point, the heat exchange pump 58 is next turned off. This scheme is hierarchically arranged in order to conserve energy by first recovering energy from the air-conditioning unit which might otherwise be lost.

Multiple heating elements similar to the electric heating element shown may be provided and controlled by a step controller to match the energy input to the heating load in stages of electric heat. An SCR controller may be used to proportionally control the amount of heat energy added to the thermal energy storage tank 16 as a function of the tank temperature differential from minimum to maximum set points. On a larger scale, such as neighborhood-wide, the electric heating controls may be circuited to allow the lock-out of the electric heating elements during periods of peak electrical demand throughout the neighborhood. This lock-out control may be in the form of an external signal, such as may be provided from the neighborhood power company, or from the owner's energy management system. The control may further be obtained from a signal from the system controls contained in the apparatus controller 30, as a function of the time of day, demand limiting, or other energy management strategies.

Figure 3:
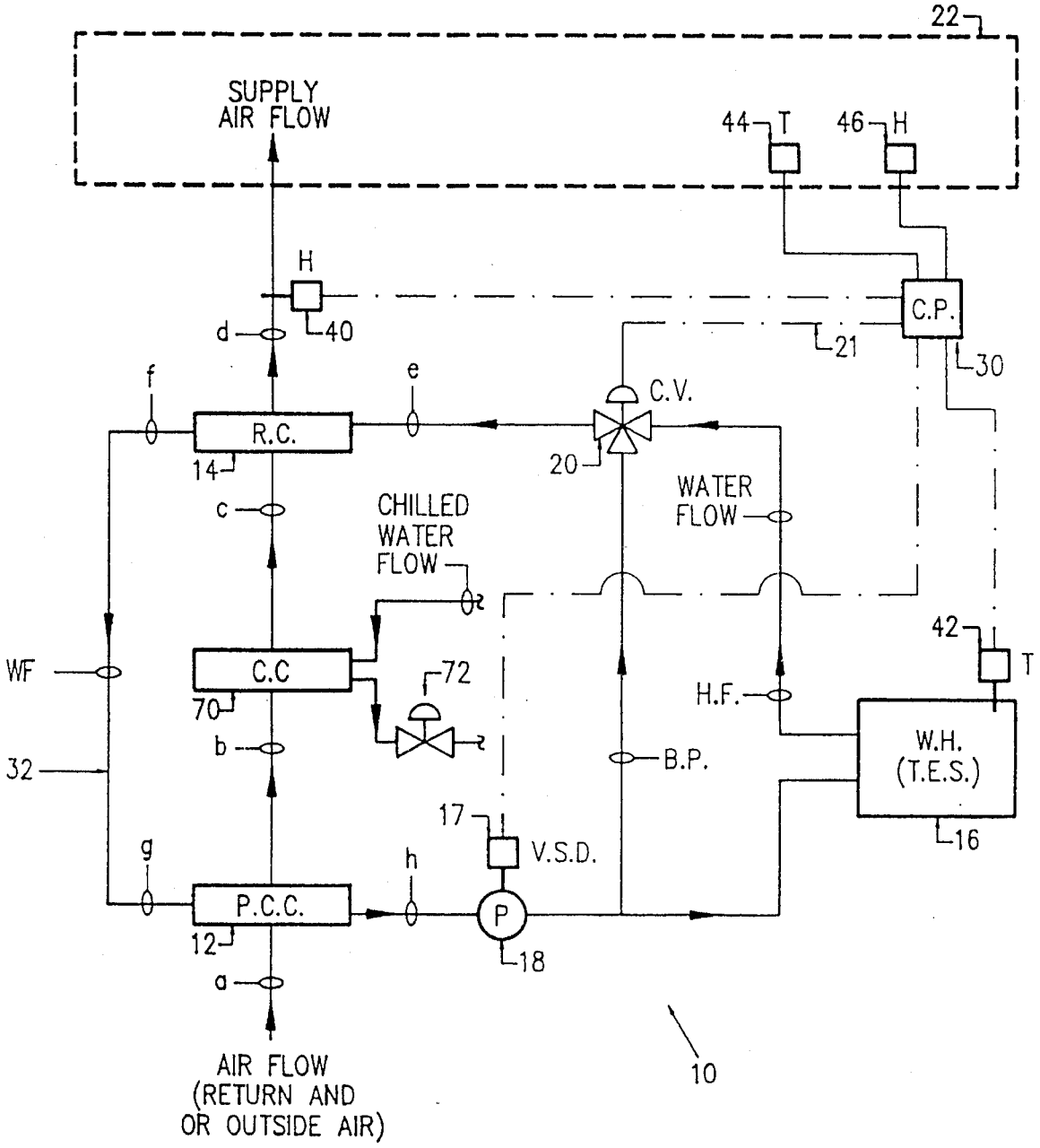
FIG. 3 illustrates a schematic of the first preferred embodiment of the invention when used with an air conditioning unit using chilled water for the cooling medium.

Referring next to FIG. 3, a schematic diagram of the first preferred embodiment of the invention is illustrated and modified for use with an air-conditioning unit using chilled water as the cooling medium. The chilled water system uses a chilled water cooling coil 70 which may be mounted in a duct or plenum, or can be mounted in an air-handling unit with integral or remote mounted fans. Chilled water systems are usually provided with a control valve 72 to regulate the amount of cooling accomplished by the system in response to the occupied space dry bulb temperature sensor 44. In the system illustrated, the coolant in the chilled water systems is different than and maintained separated from the working fluid WF.

With continued reference to FIG. 3, a reheat coil 14, as described above, is placed in the supply air flow c, d after the evaporative cooling coil 54, while a precooling coil 12 is placed in the return air flow a, b before the cooling coil 54. For full effectiveness of the air quality control measure of the instant invention, the reheat coil 14 should be mounted as close as possible to the cooling coil 54. The precooling coil 12 can be mounted in any convenient location and may be so situated as to precool only the outside air, only the return air, or a mixture of the outside air and return air (not shown).

The pump 18 is connected to a variable speed drive 17 which operates to circulate the working fluid WF, in this preferred embodiment water, between the reheat coil 14, the precooling coil 12, and the thermal energy storage tank 16. In general, the overall system may be used in various operating modes including a space cooling mode, a space dehumidification mode, and a space heating mode. To describe the operation of the system, each of the operational modes will be introduced here and described in detail below.

In the space cooling mode, the working fluid pump 18 operates when there is a demand for cooling in space 22. In this mode, the control valve 72 is responsive to the occupied space dry bulb temperature sensor 44. The pump 18 is driven by the variable speed drive 17 which regulates the water flow to maintain the desired humidity setting at the supply air flow humidity sensor 40. Water flow is increased on a rise in the relative humidity above a predetermined set point and conversely decreased on a drop in relative humidity at the supply air flow humidity sensor 40 below said set point.

In the space dehumidification mode, the air-conditioning unit is operated to maintain the humidity at the occupied space 22, as sensed by the occupied space humidity sensor 46, the speed of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature. Responsive to command signals from the apparatus controller 30 and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17.

In general terms, cooled air leaving the chilled water type cooling coil 70 enters the reheat coil 14 where it absorbs heat from the working fluid flow in the tubes of the reheat coil itself. There is a drop in heat content of the working fluid from points e to f equal to the rise in the heat content of the air stream from points c to d. The working fluid is transferred through the piping system 32 to the precooling coil 12. Cooled working fluid from the reheat coil 14 absorbs heat from the return air flow stream as it passes over the precooling coil surfaces. There is a rise in the heat content in the working fluid from points g to h equal to the drop in the heat content of the air stream from points a to b. These principles are each generally well-known and established in the air.

An electric heating element (not shown) may be used as a supplemental energy source to heat the working fluid when there is a demand for additional heat. The supplemental electric heating operation is controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., the electric heating element (not shown) is activated by the apparatus controller 30 when the thermal energy storage tank temperature drops to 120° F. On a return in the thermal energy storage tank temperature to 125° F., power to the heating element is turned off.

Multiple heating elements similar to the electric heating element described above may be provided and controlled by a step controller to match the energy input to the heating load in stages of electric heat. An SCR controller may be used to proportionally control the amount of heat energy added to the thermal energy storage tank 16 as a function of the tank temperature differential from minimum to maximum set points. On a larger scale, such as neighborhood-wide, the electric heating controls may be circuited to allow the lock-out of the electric heating elements during periods of peak electrical demand throughout the neighborhood. This lock-out control may be in the form of an external signal, such as may be provided from the neighborhood power company, or from the owner's energy management system. The control may further be obtained from a signal from the system controls contained in the apparatus controller 30, as a function of the time of day, demand limiting, or other energy management strategies.

Figure 4:
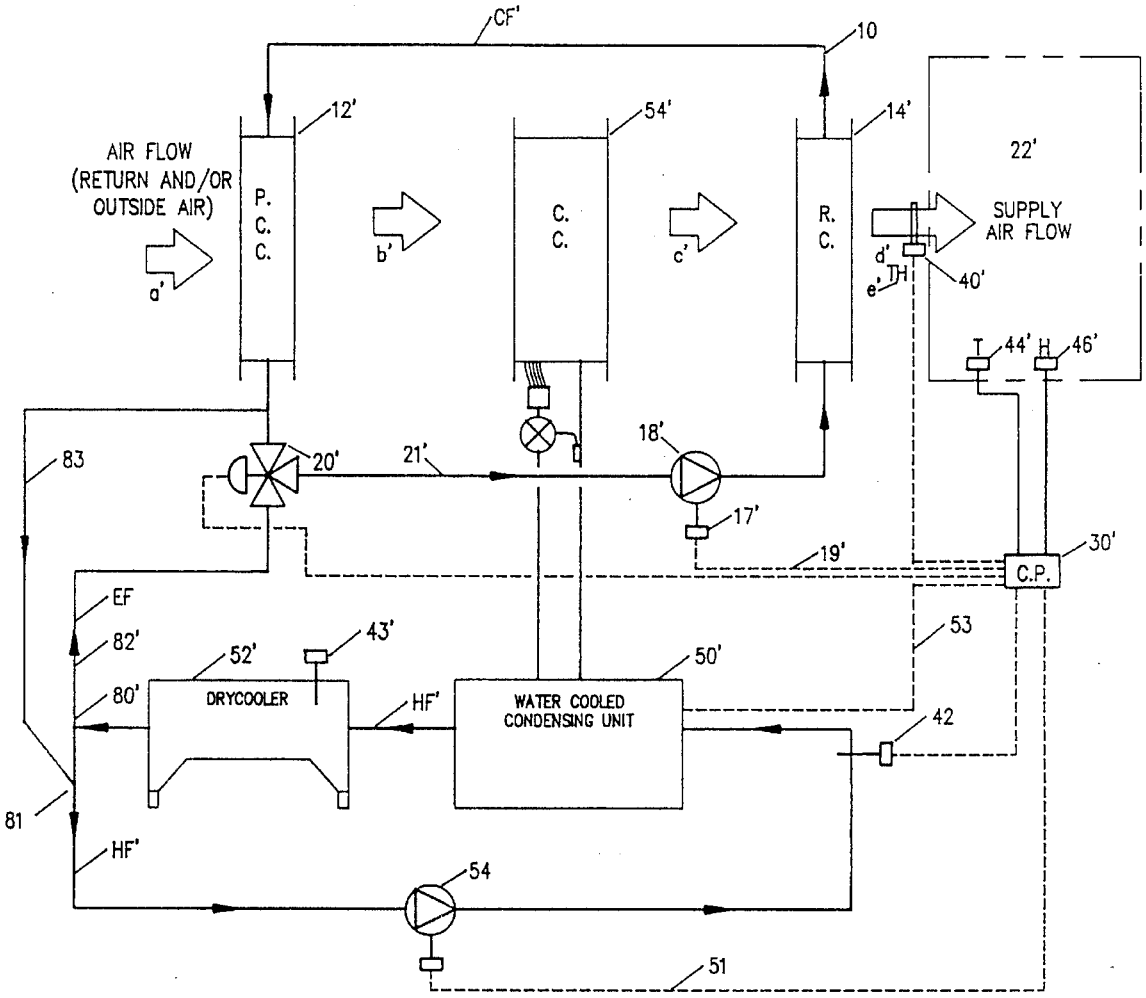
FIG. 4 illustrates a schematic view of a second preferred embodiment of the invention for latent heat extraction when used with a water cooled condenser unit type air conditioning system.

Referring now to FIG. 4, an alternative moisture control apparatus 10' for conditioning the air in an occupied space 22' is illustrated. In this embodiment, the working fluid is shared between the air conditioning apparatus and the maintenance control apparatus 10'. The air conditioning system is preferably a water cooled compressor condenser type system such as one available from McQuay as model no. RUS-041B. The apparatus 10' comprises suitably arranged components including a precooling coil 12' in a return air flow a', b', a reheat coil 14' in a supply air flow c', d', a working fluid pump 18' for circulating a working fluid through an arrangement of the above coils, a pump drive 17' for controlling the operation of the fluid pump 18' and a control valve 20' for metering the working fluid. The pump and drive may be continuously variable or modulated to motivate an average flow responsive to a duty cycle. An apparatus controller 30' generates a control valve signal for control of the valve 20' and generates pump command signals for control over the working fluid pump 18' to effect a working fluid flow.

With continued reference to FIG. 4, the working fluid includes a coil flow CF', an exchange fluid flow EF, and a heated fluid flow HF'. The coil flow CF' circulates a portion of the working fluid through the reheat and precooling coils 14', 12'. The heated fluid flow HF' passes first through a water cooled condenser unit 50', then through a dry cooler unit 52 motivated by circulating pump 54'. The dry cooler may be substituted for by a cooling tower in some applications. The exchange fluid flow EF is routed from a "T" coupler 80' directly to the control valve 20' through a conduit 82'. The flow of the coil fluid flow CF and the heated fluid flow HF' comprising the shared working fluid are motivated by the working fluid pump 18' upstream of said coupler 80' and the circulating pump 54, respectively. A mixture of exchange fluid flow EF and coil fluid flow CF' is accomplished using the control valve 20', which is responsive to the controller 30', to selectively meter the relative proportions of the bypass and heated fluid flows. A second exchange fluid flow conduit 83 permits a metered portion of the coil fluid flow CF' to return to the condenser loop via valve 20' and T connector 81.

The control valve 20' includes two input ports and an output port. A first input port is connected to the conduit 82' for receiving the exchange fluid flow EF, and the second input port is connected to the precooling coil 12' for receiving the coil fluid flow CF which circulates in the wrap around system defined by the precooling and reheat coils 12' and 14' respectively. The output port is connected to the series arrangement of the reheat coil 14' and the precooling coil 12' for flowing the coil fluid flow CF' as a mixture of heated fluid from the condenser loop with active fluid in the coil loop.

In the embodiment illustrated, the control valve is a variably adjustable blending valve responsive to an analog signal from the controller 30' for adjusting the relative proportions of the bypass and heated fluid flows over a continuum. As an alternative to the above valve type, the control valve may be a modulated valve responsive to logical signals from the controller 30'. In that alternative case, the duty cycles at the input ports control the blending of the heated and bypass fluid flows.

Also in the embodiment illustrated, the pump drive 17' is responsive to an analog pump speed command signal 19' from the controller 30' to variably control the speed of the working fluid pump 18' over a continuous range. As an alternative to the above, the pump and drive may be of a modulated variety responsive to logical signals from the controller 30'. In that alternative case, the duty cycle of the waveform from the controller 30' controls the fluid pressure and in turn volume of the working fluid circulated through the apparatus. In a further alternative instance, the working fluid pump 18' may provide a constant fluid flow or run at a constant speed in reliance on the make 20' to provide the necessary heat and mixture control.

With continued reference to FIG. 4, the apparatus controller 30' is an operative communication with a plurality of system input devices, each of which sense various physical environmental conditions. These input devices include a supply airflow humidity sensor 40' for sensing the humidity in the supply airflow, a pair of condenser loop working fluid temperature sensors 42' and 43' for sensing the temperature in the condenser loop upstream of the water cooled condenser unit 50' and at the cooler 52' respectively, an occupied space dry bulb temperature sensor 44' for sensing the dry bulb temperature in the occupied space, and an occupied space humidity sensor 46' for sensing the humidity in the occupied space. The humidity sensor 40' may be replaced with a temperature sensor for ease of maintenance and reliability or a combination of a temperature sensor and humidity sensor may be used. In some applications, no sensors will be necessary when the system operates at a calibrated set point.

In addition, the controller 30' is in operative communication with a plurality of active output devices. The output devices are responsive to signals deriving from the apparatus controller 30' according to programmed control procedures detailed below. In illustrated embodiment, the output devices comprise the control valve 20' responsive to the control valve signal 21', and the variable speed drive 17' responsive to the pump speed command signal 19'. A compressor control signal 53 controls operation of the water cooled compressor unit 50' and a condenser loop fluid flow signal 51 controls the heated fluid flow HF' by operating the pump 54. Additional input and output signals, including alarm and data logging signals or the like, may be added to the basic system illustrated in FIG. 4 as understood by one skilled in the art after reading and understanding the instant detailed description of the preferred embodiments.

In general, the overall system may be used in various operating modes including a space cooling mode, a space dehumidification mode, and a space heating mode. To describe the full operation of the system, each of the operational modes will be described in detail below.

In the space cooling mode, the working fluid pump 18' operates when the refrigeration system compressor 50' is operating. In this mode, the compressor 50' is responsive to the occupied space dry bulb temperature sensor 44'. The pump 18' is driven by the variable speed drive 17' which regulates the water flow to maintain the desired humidity setting at the supply air flow humidity sensor 40'. Water flow is increased on a rise in the relative humidity above a predetermined set point and conversely decreased on a drop in relative humidity at the supply air flow humidity sensor 40' below said set point.

In the space dehumidification mode, the compressor 50' of the conventional air-conditioning unit is operated to maintain the humidity at the occupied space 22', as sensed by the occupied space humidity sensor 46', the speed of the working fluid pump 18' is regulated to maintain the desired temperature of the occupied space 22' as sensed by the occupied space dry bulb temperature sensor 44'. In this dehumidification mode of operation, working fluid flow WF' is increased on a drop in temperature at the occupied space dry bulb temperature sensor 44', and water flow is conversely decreased on a rise in the occupied space temperature. Responsive to command signals from the apparatus controller 30' and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17'.

In general terms, cooled air leaving the evaporative type cooling coil 54' enters the reheat coil 14' where it absorbs heat from the working fluid flow in the tubes of the reheat coil itself. There is a drop in heat content of the working fluid from points e' to f' equal to the rise in the heat content of the air stream from points c' to d'. The working fluid is transferred through the piping system 32' to the precooling coil 12'. Cooled working fluid from the reheat coil 14' absorbs heat from the return air flow stream as the air passes over the precooling coil surfaces. There is a rise in the heat content in the working fluid from points g' to h' equal to the drop in the heat content of the air stream from points a' to b'. These principles are each generally well-known and established in the art.

Figure 5:
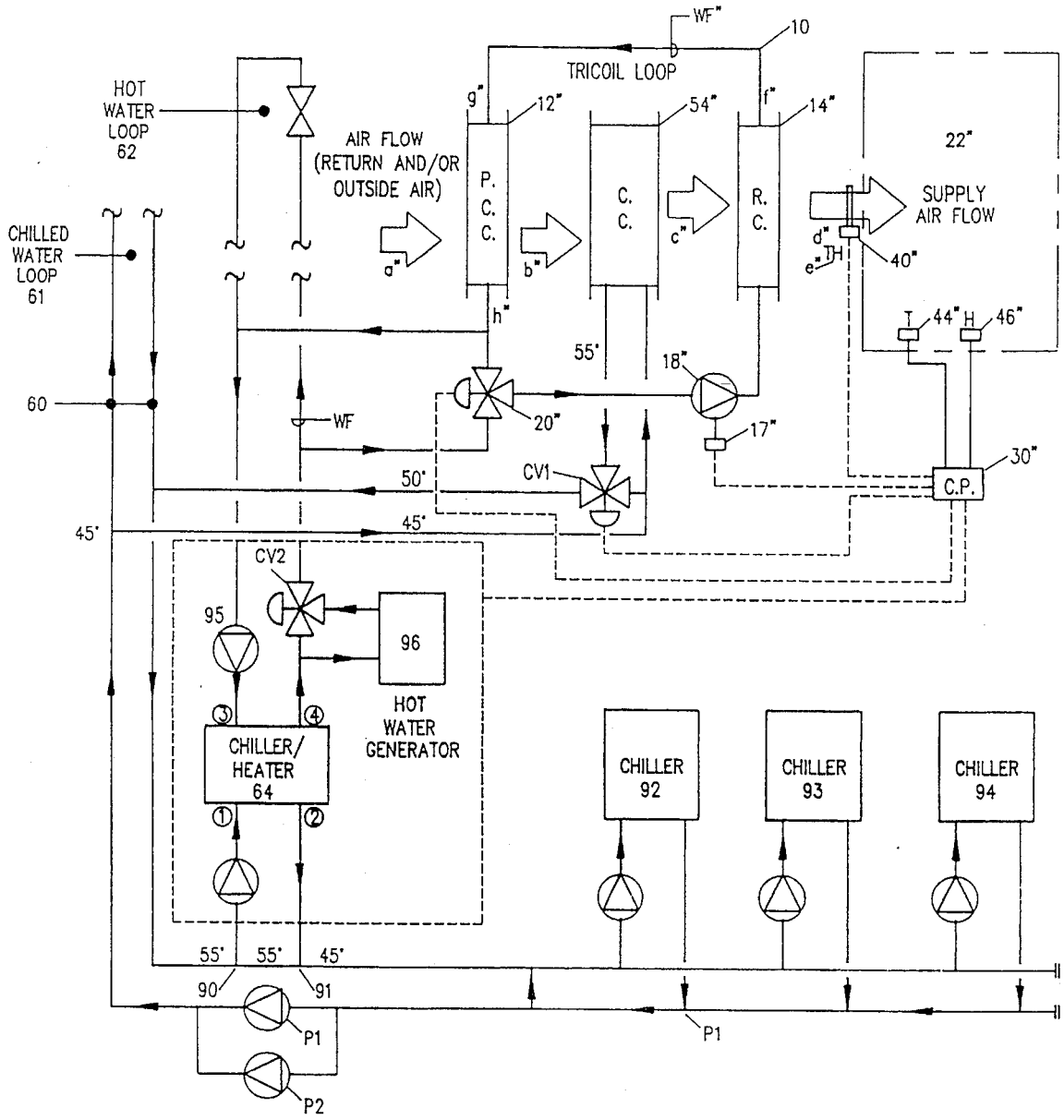
FIG. 5 illustrates a schematic view of a third preferred embodiment of the invention for latent heat extraction when used with a chilled water/heater type air conditioning system.

With particular reference now to FIG. 5, a schematic diagram of another embodiment of the apparatus of the invention is illustrated adapted for use with a conventional chiller/heater air-conditioning unit having a plurality of staggered chiller units. The system includes a compressor for compressing a compressible fluid and a condenser coil. A chilled water cooling coil 54" absorbs heat from a return air flow a", b" resulting in a cooled supply air flow c", d" into an occupied space 22".

With continued reference to FIG. 5, a reheat coil 14", as described above, is placed in the supply air flow c", d" after (downstream of) the chilled water cooling coil 54", while a precooling coil 12" is placed in the return air flow a", b" before (upstream of) the cooling coil 54". For full effectiveness of the air quality control measure of the instant invention, the reheat coil 14" should be physically mounted as close as possible to the cooling coil 54". The precooling coil 12" can be mounted in any convenient location and may be so situated as to precool only the outside air, only the return air, or a mixture of the outside air and return air (not shown).

As above, the working fluid pump 18" is connected to a variable speed drive 17" which operates to circulate the working fluid WF" between the reheat coil 14", the precooling coil 12" the mixing valve 20", and the chiller heater unit 54". In this preferred embodiment, the working fluid is water. In general, the overall system may be used in various operating modes including a space cooling mode, a space dehumidification mode, and a space heating mode. To describe the full operation of the system, each of the operational modes will be described in detail below.

In this third preferred embodiment illustrated, when there is a demand for primary cooling, pumps P1 and P2 operate to deliver chilled water to the cooling coil 54". A control valve CV1 regulates the amount of chilled water flow through the cooling coil. The chilled water in the cooling coil is warmed by the action of the cooling cycle from flow b" to flow c". The warmed chilled water is exhausted through the control valve CV1 and flows downward as illustrated in the figure toward the T coupling 90. If there is a demand for heating in the hot water circulating loop 62, the chiller heater 64" is operated and therefore the pump P1 operates to introduce the return chilled water to the chiller/heater 64". The returned chilled water is cooled by the flow into the chiller/heater 64" at node 1 and out therefrom at node 2. The energy that is extracted from the chilled water via flow into node 1 and out of node 2 of the chiller/heater 64" is added to the hot water circulating loop 62 for use in the building heating system and as a source of reheat energy, which, according to the teachings of this embodiment, flows through the wrap around system comprising the precooling coil 12" and the reheat coil 14".

The water leaving the chiller/heater at node 2 is of course colder than the water entering at point a because heat energy is extracted and imparted into the hot water circulating loop. The chilled water circulating loop 61 is therefore benefited by a reduction in temperature. The cold water is re-introduced into the main chilled water return flow at the T connection 91. The combined fluid flow leaving node 91 is colder than the main flow and may be considered to be "pre-cooled." The combined flow then proceeds to the main chiller plan for further recirculation to a succession of chiller units 92–94. The chiller/heater unit 64" is advantageously used in this embodiment to simultaneously provide a cooling of the chilled water circulating loop 61 while simultaneously imparting the heat extracted from the chilled water into the hot water circulating loop 62.

The control valve 20" is operated under the direction of the control unit 30".

The amount of heat extracted from the chilled water circulating loop 61 by the chiller/heater 64" is dependent upon the heat load in the associated building or environment. If there is not a sufficient heat load in the building, then the chiller/heater 64" is not operated. However, as the heat load in the building increases, additional cooling of the chilled water in the chilled water circulating loop 61 is executed. Thus, the heating of the hot water in the hot water circulating loop 62 is complimentary to the cooling of the chilled water in the chilled water circulating loop 61 by the action of the chiller/heater 64". In this preferred embodiment, the chiller/heater is a conventional vapor compression type unit. A flow of fluid into node 1 and out of node 2 is separated from the flow into node 3 and out of node 4.

In the space cooling mode, the working fluid pump 18" operates when the refrigeration system is operating. In this mode, the flow through the coil 54" is responsive to the occupied space dry bulb temperature sensor 44". The pump 18" is driven by the variable speed drive 17" which regulates the water flow to maintain the desired humidity setting at the supply air flow humidity sensor 40". Water flow is increased on a rise in the relative humidity above a predetermined set point and conversely decreased on a drop in relative humidity at the supply air flow humidity sensor 40' below said set point.

In the space dehumidification mode, the flow through the coil 54" of the conventional chilled water air-conditioning unit is increased to maintain the humidity at the occupied space 22", as sensed by the occupied space humidity sensor 46", the speed of the working fluid pump 18" is regulated to maintain the desired temperature of the occupied space 22" as sensed by the occupied space dry bulb temperature sensor 44". In this dehumidification mode of operation, working fluid flow WF" is increased on a drop in temperature at the occupied space dry bulb temperature sensor 44", and water flow is conversely decreased on a rise in the occupied space temperature. Responsive to command signals from the apparatus controller 30" and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17".

In general terms, cooled air leaving the cooling coil 54" enters the reheat coil 14" where it absorbs heat from the working fluid flow in the tubes of the reheat coil itself. There is a drop in heat content of the working fluid from points e" to f" equal to the rise in the heat content of the air stream from points c" to d". The working fluid is transferred through the piping system to the precooling coil 12". Cooled working fluid from the reheat coil 14" absorbs heat from the return air flow stream as the air passes over the precooling coil surfaces. There is a rise in the heat content in the working fluid from points g" to h" equal to the drop in the heat content of the air stream from points a" to b". These principles are each generally well-known and established in the art.

Heat exchange pump 95 operates when the chiller/heater 64 is operating. The function of the heat exchange pump 95 is to transfer working fluid heated by the hot refrigerant gas to the hot water circulating loop 62. The general function of the chiller/heater 64" is to both chill the water in the chilled water circulating loop 61 and provide supplemental heat to charge the hot water circulating loop 62 with hot working fluid for heating and/or reheat operation.

Referring still to FIG. 5, an auxiliary hot water generator 96 is illustrated for use as a source of heat to supplement the heat available from the chiller/heater, 64. A control valve, CV2 is used to regulate the fluid flow thru the hot water generator in proportion to the supplemental heating required.

Figure 6:
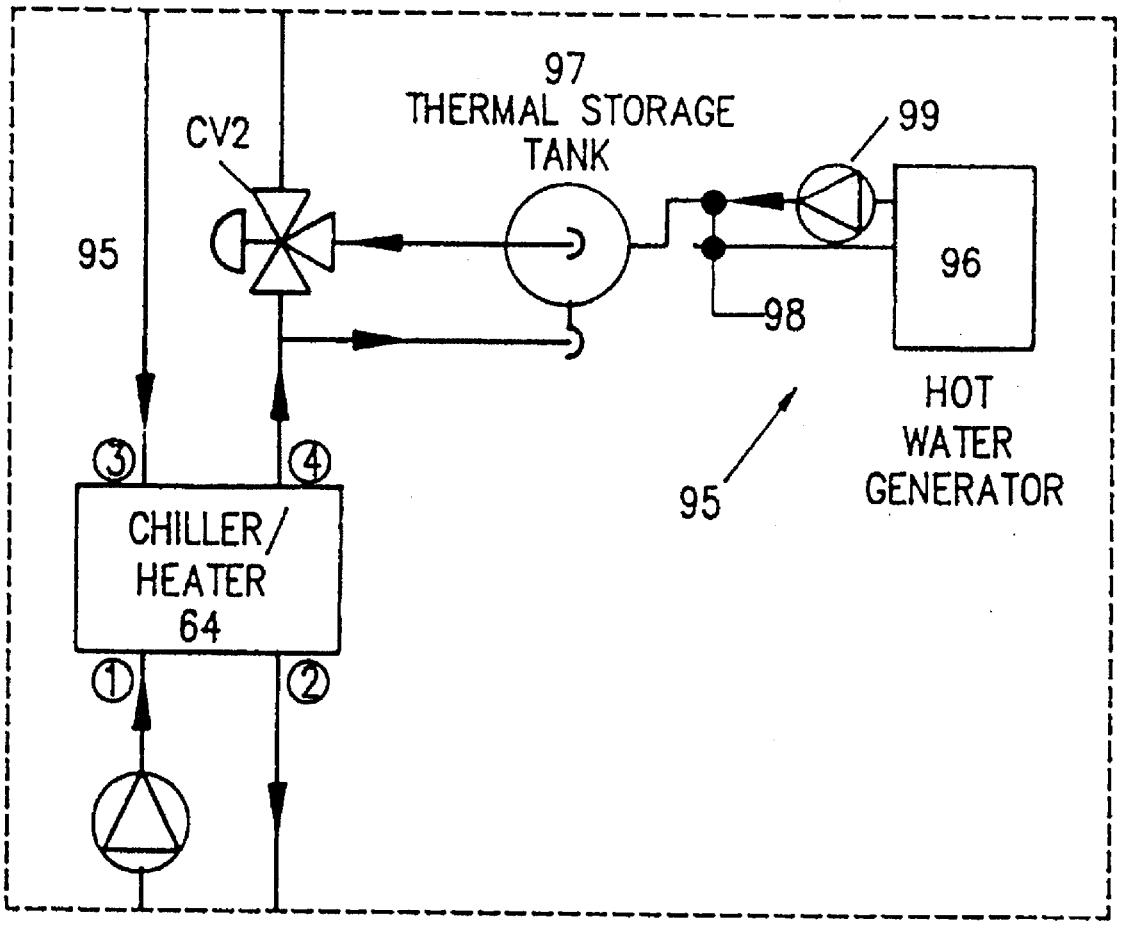
FIG. 6 illustrates a schematic view of a thermal storage system for use in the apparatus illustrated in FIG. 5.
Figure 7A:
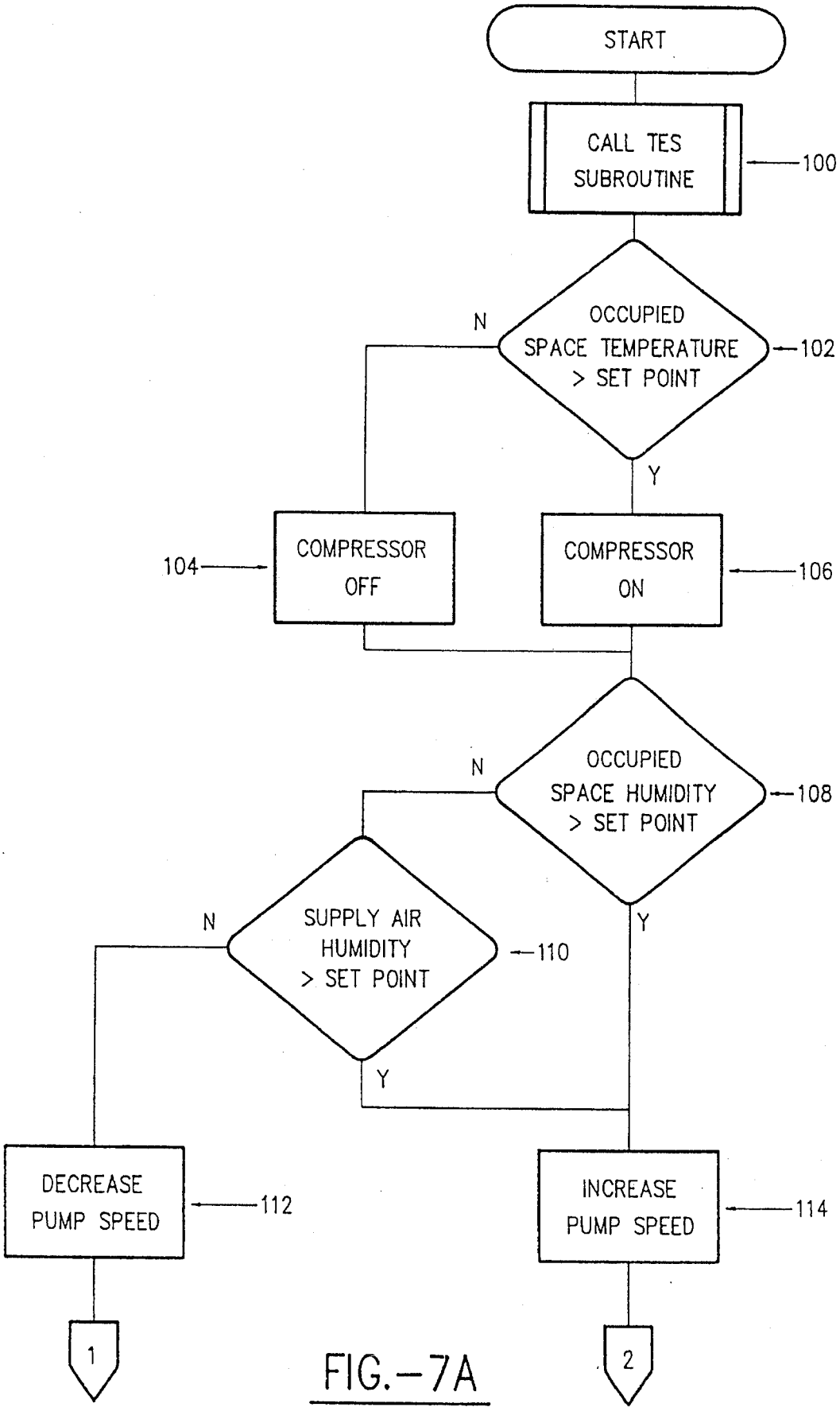
FIGS. 7*a*, 7*b* are flow charts of the control procedure executed by the control apparatus during the space cooling mode of operation.
Figure 7B:
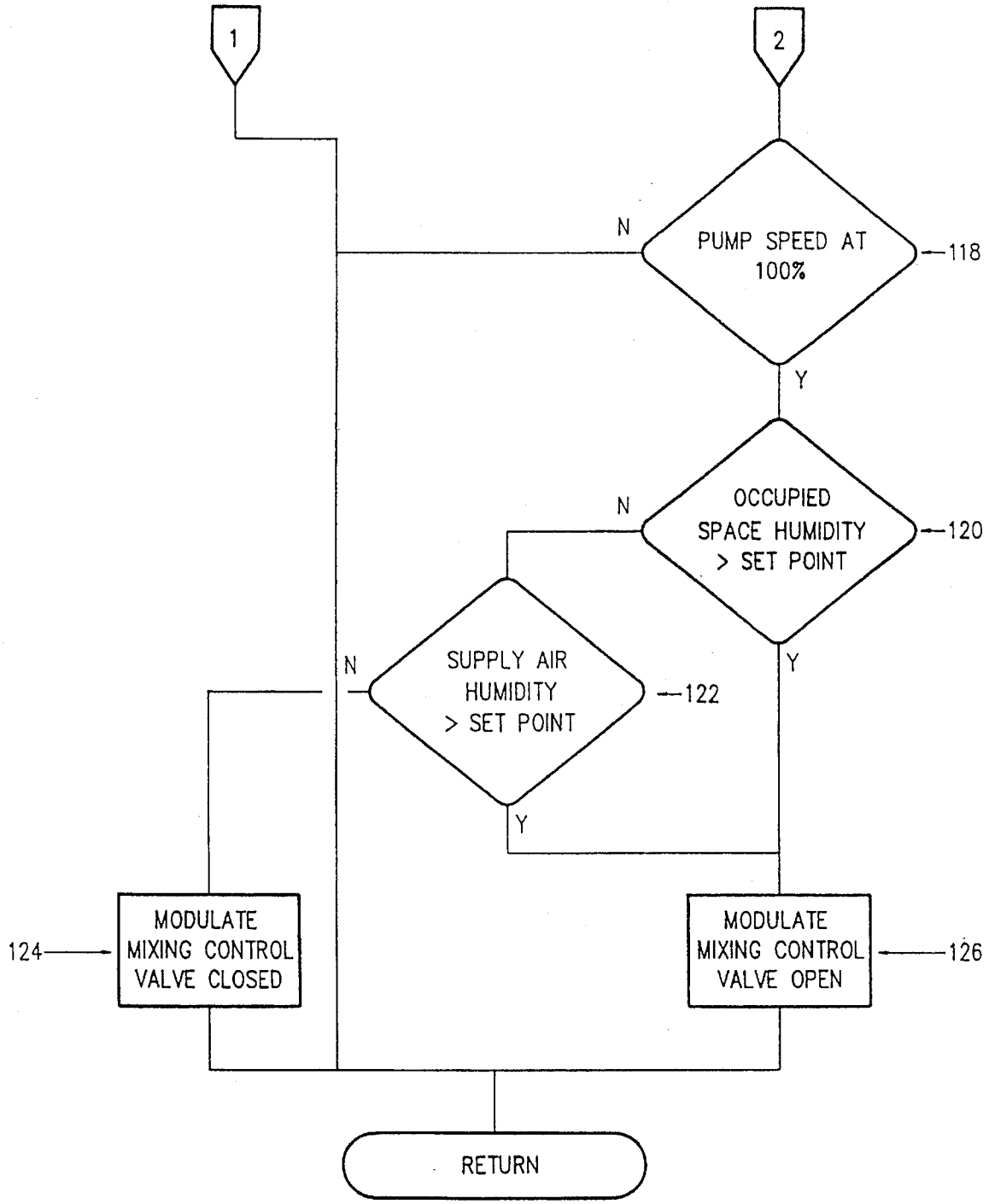
Figure 8A:
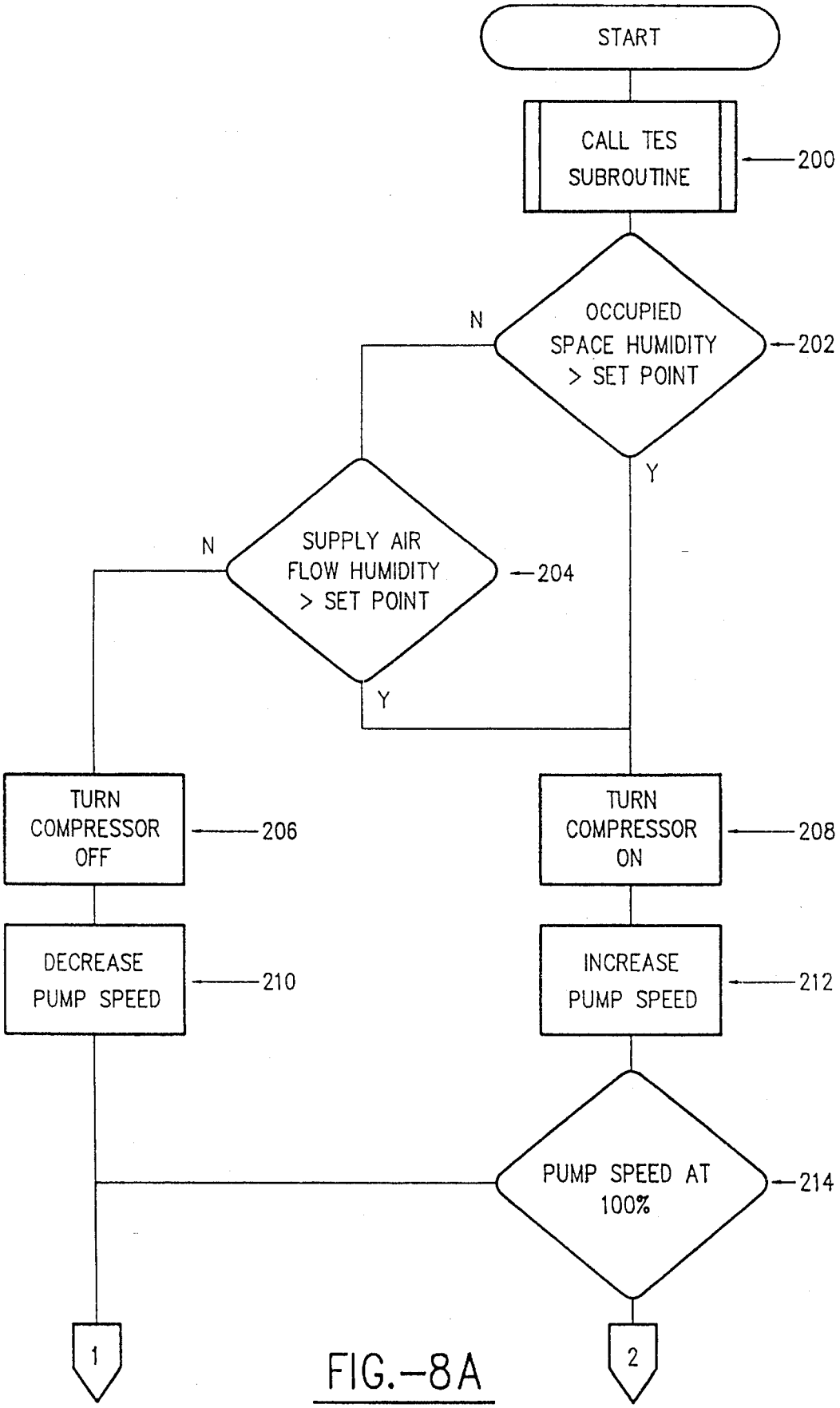
FIGS. 8*a*, 8*b* are flow charts of the control procedure executed by the control apparatus during the space dehumidification mode of operation.
Figure 8B:
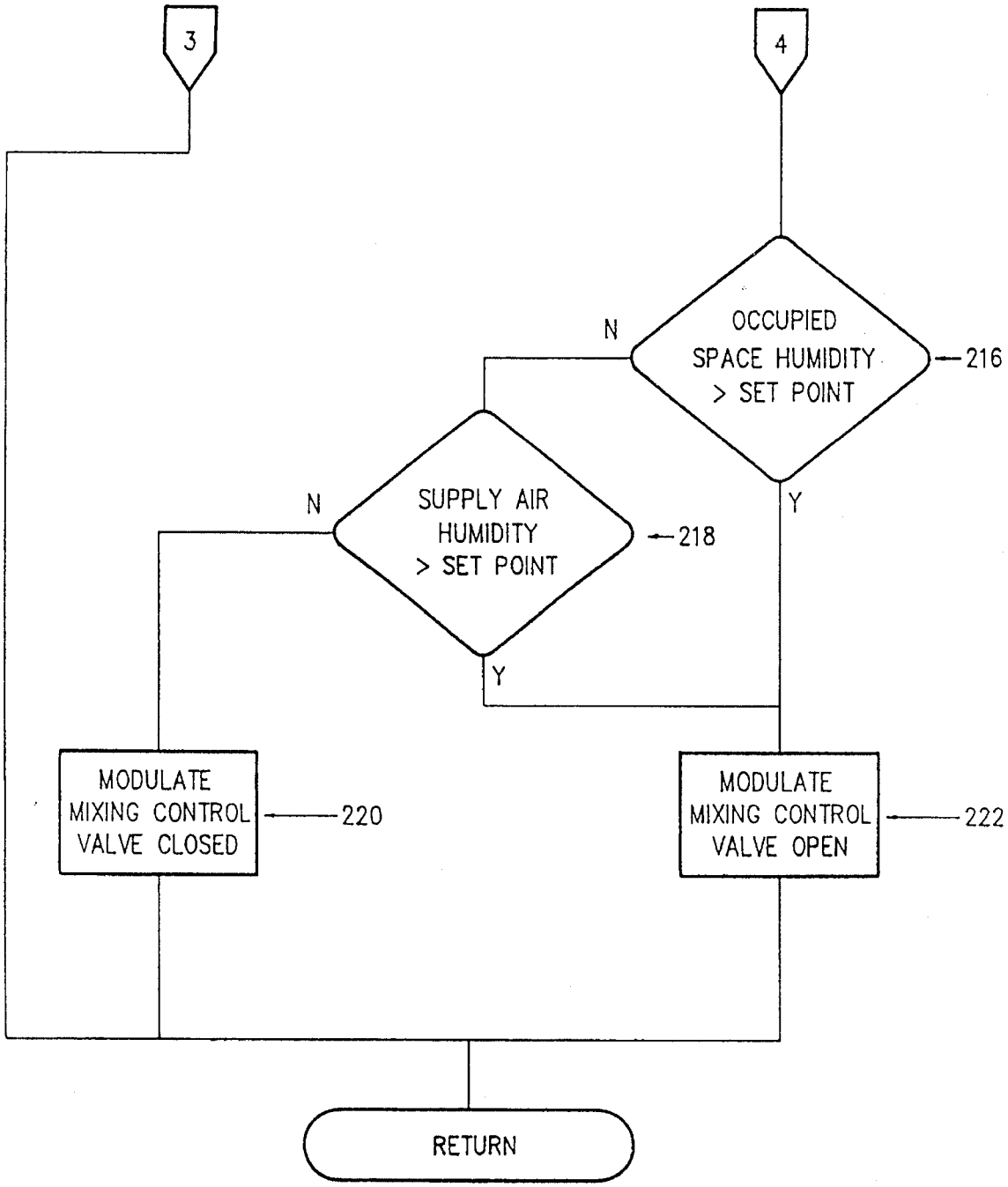
Figure 9:
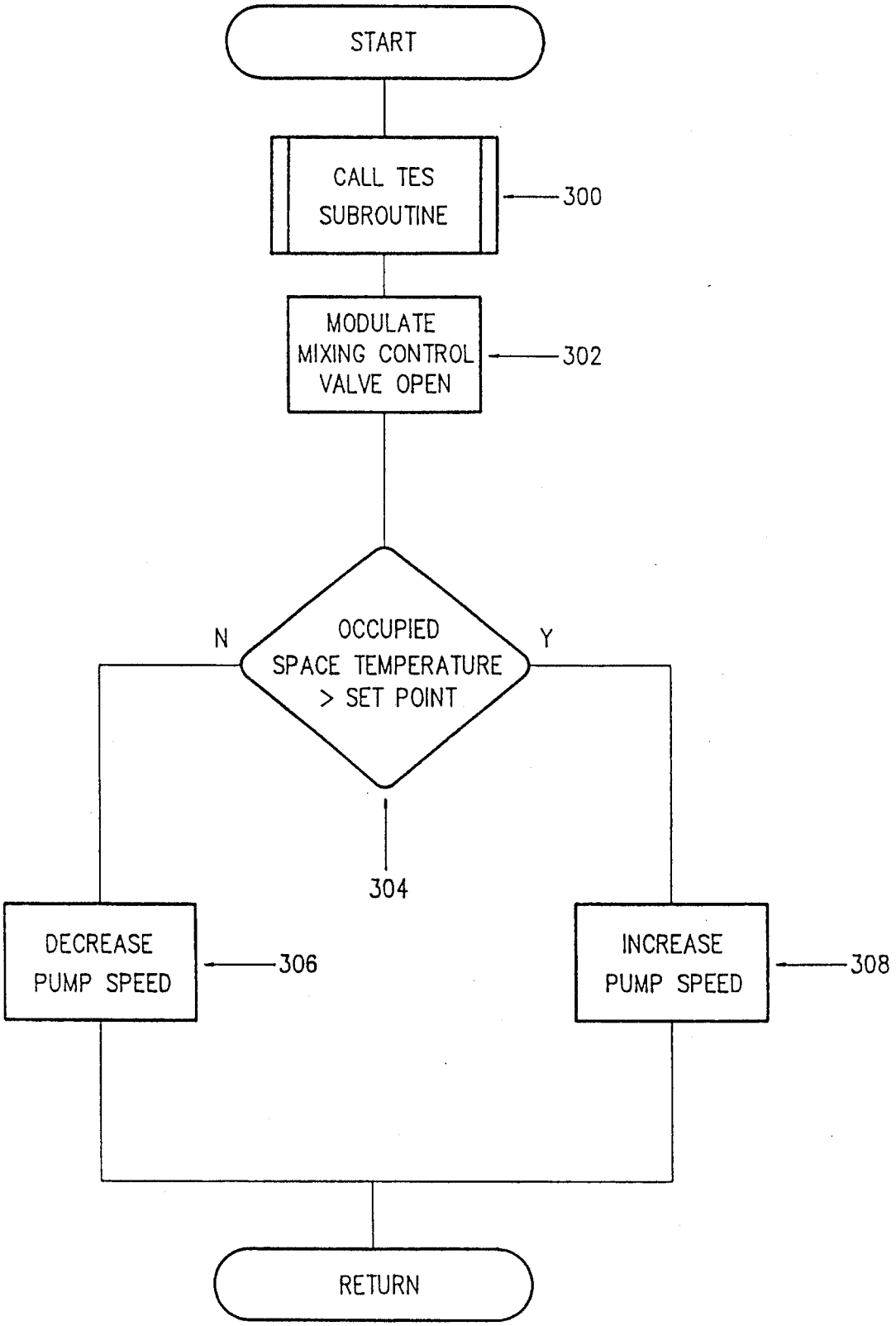
FIG. 9 is a flow chart of the control procedure executed by the control apparatus during the space heating mode of operation.

Referring now to FIG. 6, the auxiliary hot water generator 96 is illustrated for use with a thermal storage tank apparatus. The hot water generator 96 is used to heat the working fluid in the thermal storage tank 97 which is connected to the hot water generator 96 through a pair of conduits 98. One of the pair of conduits includes a fluid pump mechanism 99 which motivates a fluid flow between the hot water generator 96 and the thermal storage tank 97. A control valve CV2 meters the flow of hot water from the hot water storage tank 97 into the hot water circulating loop 62. The thermal storage tank is useful in situations where it is desirable to operate the heater during certain periods of the day or week when the utility unit costs rules are low and store the energy in the water tank for use in the heating system during periods of time when the utility unit costs rules are high.

With reference now to FIGS. 2, 3, 4, 5, 7*a* and 7*b*, the control method for the space cooling mode operation will be described. In the space cooling mode, the compressor 50 of FIG. 2 and the chilled water cooling coil 70 of FIG. 3 are operated 104, 106 to maintain the desired set point dry bulb temperature in the occupied space 22 according to the occupied space dry bulb temperature sensor 44. In the conventional air-conditioning system, the compressor 50 starts 106 on a rise in occupied space temperature above a predetermined set point and stops 104 on a fall in occupied space temperature below the set point temperature 102 as sensed by the occupied spaced dry bulb temperature sensor 44. Correspondingly, in the chilled water system, the control valve 20 opens 106 on a rise in the occupied space temperature and closes 104 on a fall in the occupied space temperature below the predetermined set point at occupied space dry bulb temperature sensor 44. In either case, the speed of the working fluid pump 18 is regulated by the variable speed drive 17 to maintain the desired relative humidity 110 in the supply air flow d as sensed by the supply air flow humidity sensor 40.

The pump speed is also controlled to maintain the desired relative humidity 108 in the occupied space 22 according to the occupied space humidity sensor 46. The working fluid pump speed increases 114 on a rise in the relative humidity above the supply air or the occupied space air relative humidity set points. The working fluid pump speed decreases 112 on a fall in the relative humidity below the set points.

When the variable speed drive 17 is at full speed 118, the control valve 20 is modulated to maintain the desired humidity set points 120, 122. The control valve 20 is positioned to bypass the thermal energy storage tank 16 when the working fluid pump 18 is operating at speeds of less than 100% of full speed. When the variable speed pump 18 is at full speed, the control valve 20 is modulated open 126 to thermal energy storage tank 16 on a rise in supply air 122 or occupied space 120 relative humidity above the predetermined set points according to the supply air flow humidity sensor 40 and the occupied space humidity sensor 46 respectively. In this state, the working fluid flows to the reheat coil 14 directly from the thermal energy storage tank 16 as a heated working fluid flow HF. The control valve 20 is modulated closed 124 on a decrease in the supply air or occupied space air relative humidity below the predetermined set points.

Next, with reference to FIGS. 2, 3, 4, 5, 8*a* and 8*b*, the control method for the space dehumidification operating mode will now be described. During this mode, when the occupied space dry bulb temperature set point is satisfied according to the occupied space dry bulb temperature sensor 44, the compressor 50 of the conventional air conditioning unit is operated to maintain the desired occupied space relative humidity. In the chilled water system, the chilled water control valve 72 is operated to maintain the desired occupied space relative humidity. In this mode, the compressor 50 or the chilled water control valve 72 operate 208 on a rise in the occupied space relative humidity 202 above the set point and stop 206 on a drop in the occupied space relative humidity 202 below said set point. The working fluid pump 18 and control valve 20 are controlled 210–222 according to the space cooling mode described above.

With reference next to FIGS. 2, 3, 4, 5 and 9, the control method for the space heating operating mode will now be described. In this mode, the thermal energy storage tank 16 is utilized to maintain the desired occupied space dry bulb temperature according to the physical conditions sensed by the occupied space humidity sensor 46. Normally in this mode, the compressor 50 and chilled water control valve 72 are both off in the standard air-conditioning system and chilled water systems respectively. In the instant space heating mode, the working fluid WF is circulated exclusively through the thermal energy storage tank 16 as a heated fluid flow HF. No flow is permitted through the bypass as a bypass fluid flow BP. This is accomplished via the control valve 20 modulated open 302 according to the control valve signal 21 from the apparatus controller 30. The speed of the working fluid pump 18 is adjusted 306, 308 to maintain the desired temperature set point 304 in the occupied space 22. As an alternative means, the working fluid pump 18 may be continuously operated, but cycled on and off according to the demand for heating as sensed by the occupied space dry bulb temperature sensor 44. This results in an average heating defined by the duty cycle of the alternating on/off cycles.

Figure 10:
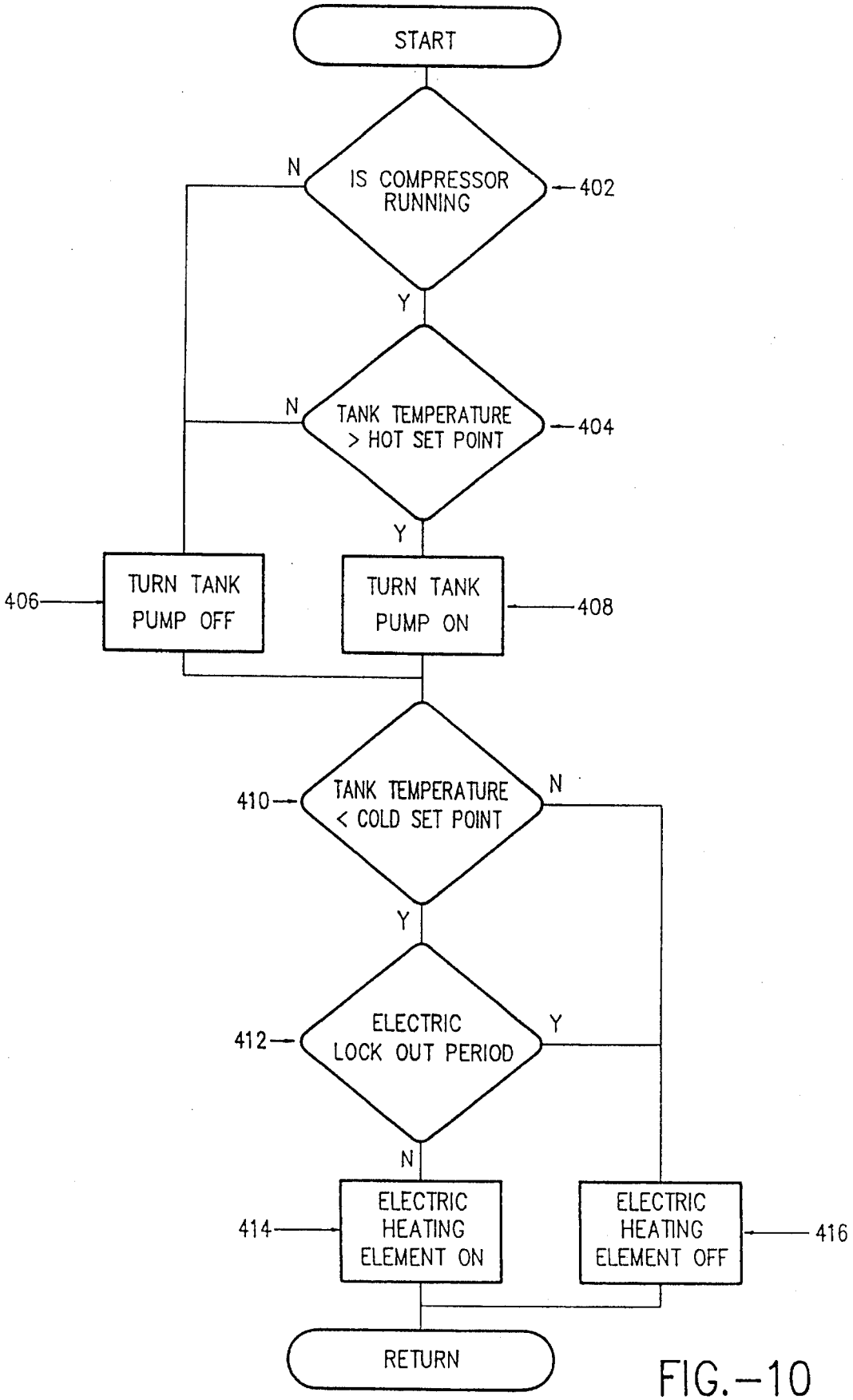
FIG. 10 is a flow chart of the control procedure executed by the control apparatus during the various operational modes for maintenance of the thermal energy storage tank temperature used in the first preferred embodiment.

With reference now to FIG. 10, the thermal energy storage tank maintenance routine TES for use with the embodiments illustrated in FIGS. 1–3, will be now described in detail. The method is a subroutine in each of the space cooling, space dehumidification, and space heating control methods described above. In this control subroutine procedure, heat exchange pump 58 operates 408 when the compressor 50 is operating 402 and when the temperature in the thermal energy storage tank 16 is below the set point 404 at temperature sensor 42. The function of pump 58 is to transfer water WF heated by the hot refrigerant gas in the heat exchanger 56. The pump stops 406 when the temperature in the tank is at the upper water temperature set point 404 at the temperature sensor 42. The function of the heat exchanger is to provide supplemental heat to charge the thermal storage tank 16 with hot water for heating and/or reheat operation.

Electric heating element 60 may be used as an additional energy source to heat the water when there is a demand for more heat than can be provided by the heat exchanger. The electric heating operation is controlled by the apparatus controller 30 to operate 414 as the second source of energy when the temperature in the thermal storage tank 16 drops below the desired set point 410 at sensor 42. As an example, if the desired minimum temperature in the tank is 120° F. and the desired maximum temperature is 125° F., the pump 58 starts on a drop in temperature below 125° F. When the tank temperature drops to 120° F., the electric heating element 60 is activated. On a rise in tank temperature the heating elements are turned off first 416, and on a continued rise in temperature to 125° F. the pump 58 is, in turn, shut off 406. Multiple heating elements may be provided and controlled by a step controller to match the energy input to the heating load in stages of electric heat or an SCR controller can be used to proportionately control the amount of heat energy added to the tank as a function of the tank temperature differential from minimum to maximum set points.

The electric heating controls may further be circuited to allow for a lock out 416 of the electric heating elements during periods of peak community electrical demand 412. This lock out control could be provided from an external signal such from the power company or from the owner's energy management system. The control could be from a signal from the system controls contained in control 30 as a function of time of day, demand limiting, or other energy management strategies.

With reference once again to FIG. 2, 4 and 5 the system may be operated in a variety of modes. In general, when the overall system is operating in either the cooling mode or the dehumidifying mode the cold air leaving the evaporator coil 50 enters the reheat coil 14 where it absorbs heat from the moving water stream WF in the tubes of the reheat coil 12. There is a corresponding drop in the heat content of the circulating water from points e to f equal to the rise in heat content of the air stream from points c to d. The water WF is transferred through a piping conduit system to the precooling coil. Cold water entering the precooling coil 12 absorbs heat from the return air stream a as it passes over the coil surfaces. There is a rise in heat content of the circulating water from points g to h equal to the drop in heat content of the air stream from points a to b. Representative sample calculations follow below.

SAMPLE CALCULATIONS

Figure 11:
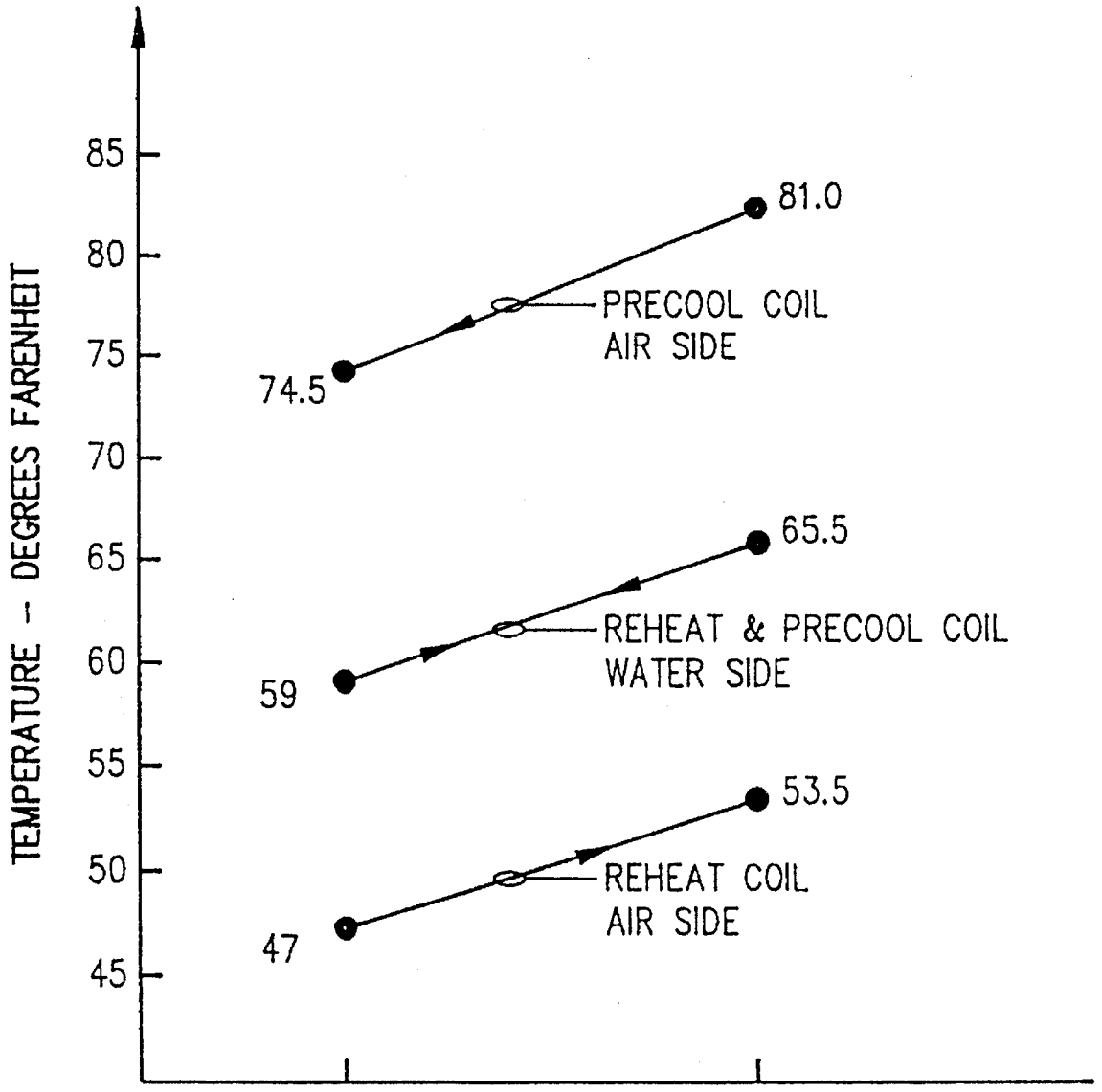
FIG. 11 is a coil graph of a first sample calculation.

The sample calculation A immediately below is illustrated in the coil graph of FIG. 11 and in the psychometric chart of FIGS. 11*a*, 11*b* wherein it is Given that:

Required indoor temperature is 75° F. at 45% relative humidity;

Indoor cooling load (peak load) is

| | |
|---|---|
| 220.0 | MBTU/Hour Sensible |
| 94.3 | MBTU/Hour Latent |
| 314.3 | MBTU/Hour Total; |

Outdoor air temperature at peak cooling load is 93° F. dry bulb and 76° dry wet bulb;

Amount of ventilation air (outside air) required is 2500 CFM;

Desired supply air relative humidity level is 70% maximum;

Return air heat gain assumed equal to a 2° F. ΔT rise; and

Fan and motor heat gain assumed equal to a 1½° F. ΔT rise.

Statement of Solution:

$$\text{Sensible heat ratio} = \frac{220.0}{314.3} = 0.70$$

Room condition line intersects 70% *RH* line at 55° F.

Supply air volume required:

$$V = \frac{220000\ \text{BTU/HR}}{1.1 \cdot 20°\ \Delta T}$$

Reheat energy required to provide 70% Rel. Hum. in supply air stream:

-continued $Q = 10000\ CFM \cdot 1.1 \cdot [(55-47)°\ F.\Delta T - 1\frac{1}{2}°\ F.)]$ $= 71500$ BTU/HR Water flow rate required through reheat coil assuming 6½° F. $\Delta T$ and 12° F. approach temperature:

$V = 71500$ BTU/Hour/(500 · 6.5° F. $\Delta T$) = 22 $GPM$

Coil conditions – Temperature:

| | Air | Water |
|---|---|---|
| Entering Coil | 47 | 65.5 |
| Leaving Coil | 53.5 | 59.0 |

Precooling coil air temperature drop (sensible cooling):

$$\Delta T = \frac{Q}{1.1 \cdot CFM}$$

$Q$ = Amount of energy recovered for supply air stream at reheat coil $\Delta T = 71500$ BTU/Hour/1.1 · 10000$CFM$ = 6.5° F. $\Delta T$ Coil conditions – Temperature

| | Air | Water |
|---|---|---|
| Entering Coil | 81 | 59 |
| Leaving Coil | 74.5 | 65.5 |

Figure 12:
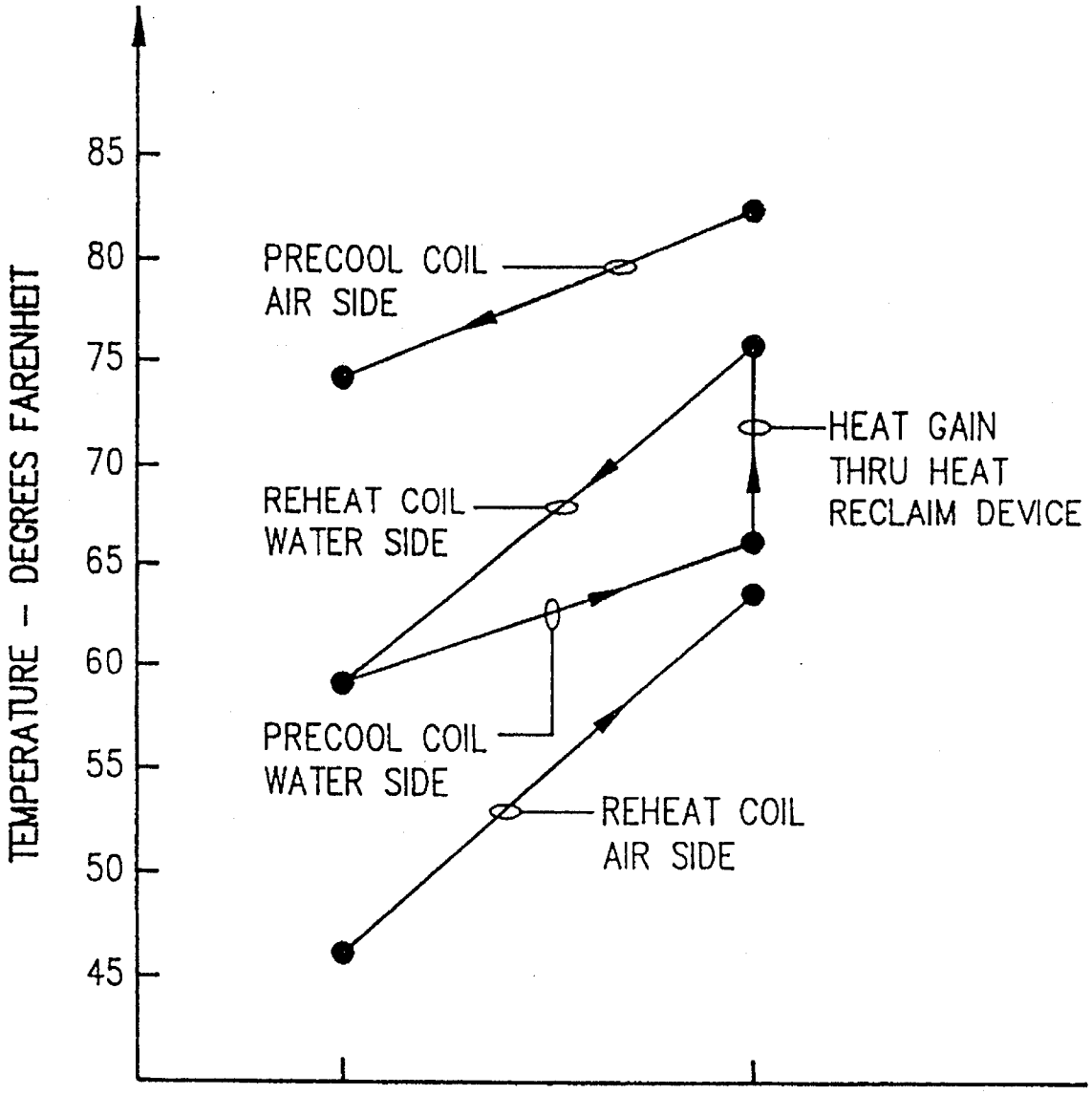
FIG. 12 is a coil graph of a second sample calculation.
Figure 13:
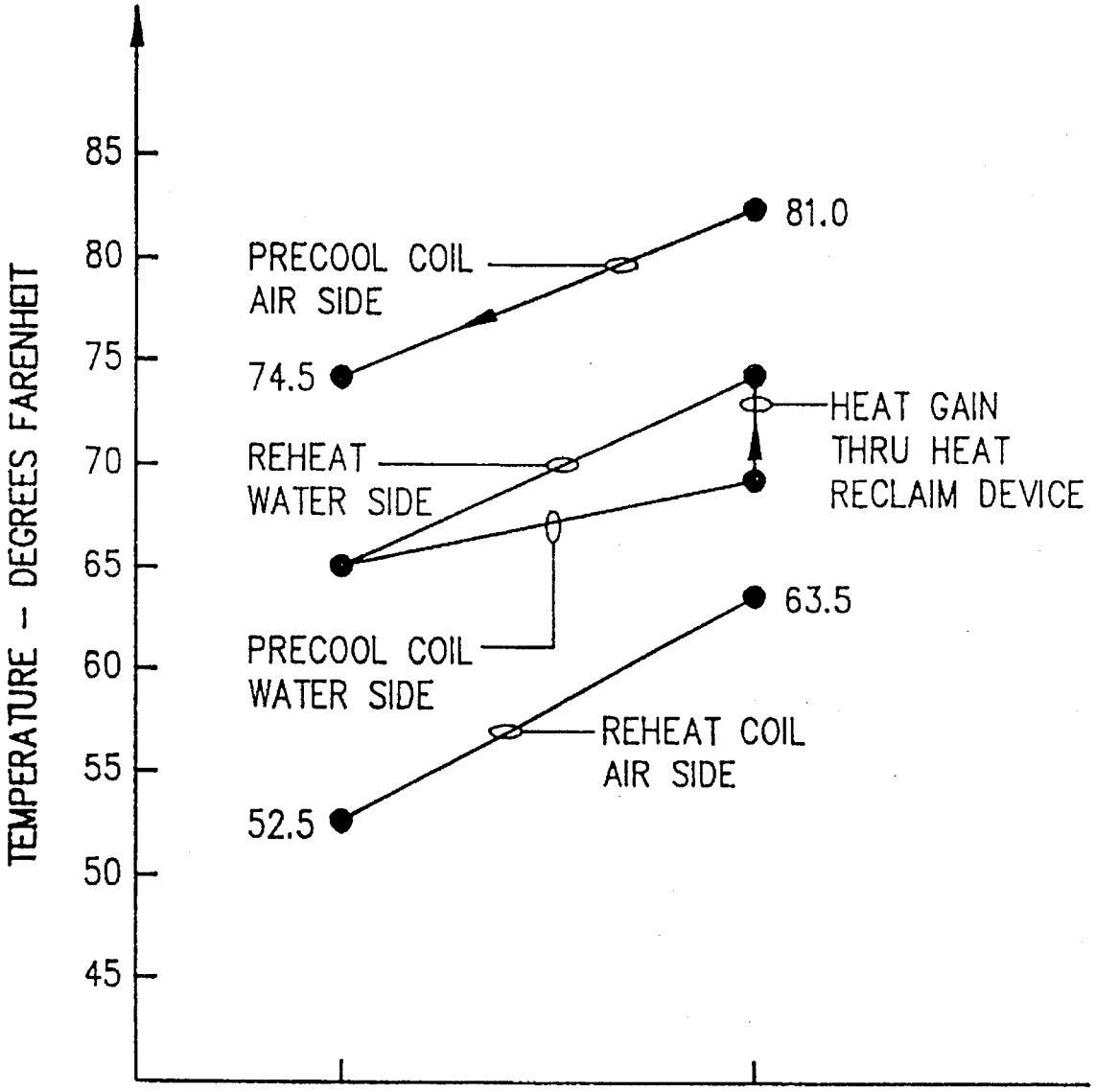
FIG. 13 is a coil graph of a third sample calculation.
Figure 14A:
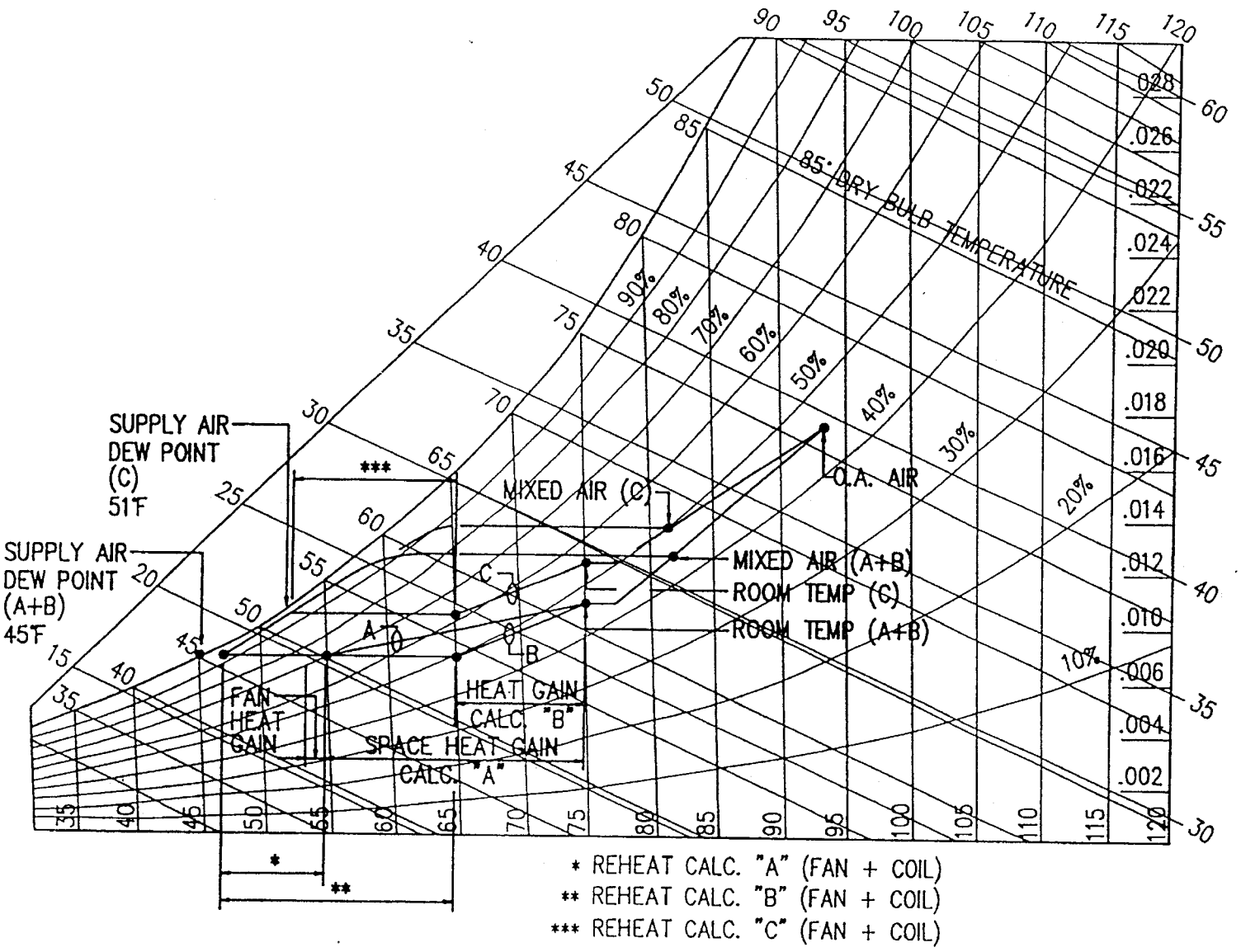
FIG. 14*a*, 14*b* are a psychometric chart of the combined first, second and third sample calculations and a protractor for use with the psychometric chart.
Figure 14B:
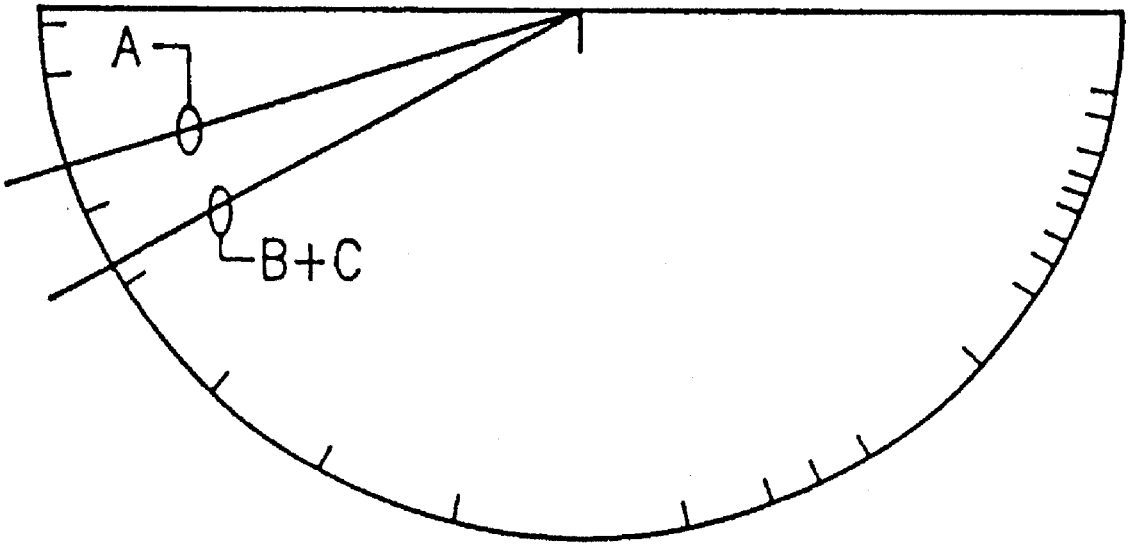

The sample calculation B immediately below is illustrated in the coil graph of FIG. 12 and in the psychometric chart of FIGS. 14*a*, 14*b* wherein it is Given that:

Same condition as calculation (A), except indoor sensible cooling load is 110.0 MBTU/Hour; and, Assume supply air dew point is fixed at 45° F. due to coil characteristics;

Statement of Solution:

New sensible heat ratio $$\frac{110.0}{110+94.3} = 0.54$$

Reheat energy required $Q = 10000\ CFM \cdot 1.1 \cdot [(65-47)°\ F.\Delta T - 1\frac{1}{2}°\ F.)]$ $= 181500$ BTU/hour Water temperature required using 22 $GPM$ flowrate $$\Delta T = \frac{181500\ \text{BTU/hour}}{22GPM \cdot 500} = 16.5°\ \Delta T\ °F.$$

Reheat enenergy required from refrigerant heat recovery:

$Q_3 = Q_1 - Q_2$ $Q_1$ = Total reheat required $Q_2$ = Wate heat gain in precooling coil (from Calculation (*A*))

$Q_3 = 181500 - 71500$ BTU/hour = 110,000 BTU/hour

Temperature rise required by water through heat reclaim device:

$$\Delta T = \frac{Q_3}{500} \cdot 22\ GPM = \frac{110000}{500} \cdot 22\ GPM = 10°\ F.$$

The sample calculation C immediately below is illustrated in the coil graph of FIG. 12 and in the psychometric chart of FIGS. 14*a*, 14*b* wherein it is Given that:

Same conditions as Calculation (A), except:

Space sensible cooling load is 110 MBTU/hour

Refrigeration compressor(s) provided with capacity reduction to reduce amount of refrigerant flow, matching the new cooling load; this results in an increased dew point in the supply air.

Statement of Solution:

Assuming capacity reduction raises the supply air dew point to 51° F.;

Space condition line intersects dew point line as 65° F. db, this is the supply air dry bulb temperature; space condition line extends up and to the right, establishing a new room condition of 75° F. at~53% relative humidity.

The sample calculation immediately below illustrates the Heating Mode of operation wherein it is Given:

Space heating load is 216000 BTU/Hour, peak;

Supply air volume is 10,000 CFM (from Calculation (A));

Desired space temperature is 72° F.;

Outside air temperature is 35° F; and,

Outside air volume is 2500 CFM.

Statement of Solution:

Supply air temperature required is $$T_s = \frac{72°\ F.\ 216000\ \text{BTU/hour}}{1.1 \cdot 10000\ CFM} = 72°\ F. + 20 = 92°\ F.$$

Mixed air temperature is:

$T_m = 72°\ F. \frac{216000\ \text{BTU/hour}}{10000\ CFM} \cdot (72-35)°\ F.$ $= 321750$ BTU/hour = 94KW Heat provided from thermal storage – ASSUMPTIONS: full heating shift to OFF peak, 10 hour heating period, 60% diversity.

Heating required:

$Q = 10$ hours · 321750BTU/hour · .6 diversity $= 1930500$ BTU

Heat input to thermal storage:

During moderate temperature periods recovered heat would be used to charge the storage tank. During cold weather, when the cooling system is off, the electric heat would be used to store the energy.

Electric heater size:

$Q = 1930500$ BTU/14 hours = 137900 BTU/hour $= 40$ KW*

Thermal storage volume required – ASSUMPTIONS: minimum useful temperature is 100° F. and storage temperature is 140° F.

$$V = \frac{1930500\ \text{BTU}}{8.35\ \text{lb/gal.} \cdot 1\ \text{BTU/lb} \cdot °F. \cdot (140-100)°\ F.}$$

$V = 5780$ Gallons

The amount of storage could be reduced if the electric heat is allowed to operate during the peak period (at a reduced rate to provide some demand saving):

$$V = \frac{1930500\ \text{BTU} - 10\ \text{hrs} \cdot 20\text{KW} \cdot 3413\ \text{BTU/KW}}{8.35\ \text{lb/gal.} \cdot 1_{BTU/lb} \cdot °F.}$$

$V = 3736$ Gallons

*Heater size and/or storage volume would be increased slightly to account for system loses.

The invention has been described with reference to the preferred embodiments. Obviously modifications and alterations will occur to others upon a reading and understanding of this specification. It is my intention to include all such modifications and alterations insofar as they come within the scope of the appended claims and equivalents thereof.

Having thus described the invention, I now claim:

1. A moisture control apparatus in combination with a water cooled air conditioning system of the type having a condenser, a compressor for compressing a compressible fluid, a cooling fluid in a first conduit for cooling the condenser through a heat exchange means and a cooling coil where the compressible fluid decompresses absorbing thermal energy from a return air flow as a cooled supply air flow, the moisture control apparatus comprising:

precooling coil means in said return air flow for exchanging thermal energy between the return air flow and the cooling fluid;

reheat coil means in said supply air flow for exchanging thermal energy between the cooling fluid and the supply air flow;

fluid pump means for motivating a flow of the cooling fluid through said precooling coil means, said reheat coil means, and said heat exchange means;

second fluid conduit means containing the cooling fluid therein for directing the cooling fluid through a series arrangement of said precooling coil means, said heat exchange means, and said first conduit; and, regulating means for regulating said cooling fluid flow through said precooling and reheat coil.

2. The moisture control apparatus combination according to claim 1 wherein said regulating means comprises a control valve connected to said second fluid conduit means in said series arrangement.

3. The moisture control apparatus combination according to claim 2 wherein said control valve comprises a first input port connected to said first fluid conduit means for receiving a first flow of said cooling fluid from said water cooled air conditioning system, a second input port connected to said second conduit means for selectively flow receiving and recirculating said cooling fluid from said precooling coil means, an output port connected to said second fluid conduit means for exhausting said first and second flows from said control valve to said reheat coil means, and valving means for selectively metering said first and second flows through said control valve as a metered flow.

4. The moisture control apparatus combination according to claim 3 wherein said fluid pump means comprises a variable speed drive fluid pump.

5. The moisture control apparatus combination according to claim 4 further comprising control means operatively associated with said control valve and said variable speed drive fluid pump for sensing moisture in said supply air flow and for maintaining said sensed moisture at a predetermined set point by regulating i) said valving means to selectively blend said first and second flows, and ii) said variable speed drive fluid pump to motivate the metered flow through said series combination of said reheat coil means and said precooling coil means.

6. The moisture control apparatus combination according to claim 5 further comprising a dry cooler connected to said first fluid conduit means and operatively associated with said cooling fluid for exchanging thermal energy from cooling fluid with ambient air.

7. An apparatus comprising the combination of: a water cooled air conditioning system including:

a cooling coil means for selectively absorbing thermal energy from a return airstream as a cooled airstream; and, a water cooled condenser unit having an integral compressor and condenser, the condenser and compressor being cooled by a working fluid; and, a humidity control apparatus including:

precooling coil means disposed upstream of said cooling coil means for precooling said return airstream;

reheat coil means disposed downstream of said cooling coil means for reheating the cooled airstream flowing from said cooling coil means;

sensing means disposed downstream of said reheat coil means for sensing the relative humidity of the reheated airstream flowing from said reheat coil means and generating a humidity signal reflective of said sensed relative humidity;

conduit means connecting said precooling and reheat coil means for communicating said working fluid flow through a closed loop circuit comprising said precooling coil means and said reheat coil means;

pump means for controlledely motivating the working fluid flow through said closed loop circuit at a controlled flow rate responsive to said humidity signal; and, means for selectively introducing thermal energy into said working fluid flow responsive to i) said humidity signal.

8. A moisture control apparatus in a water cooled air conditioning system of the type having a condenser, a compressor for compressing a compressible fluid, a cooling fluid in a first conduit for cooling the condenser through a heat exchanger, and a cooling coil where the compressible fluid absorbs thermal energy from a return air flow as a cooled supply air flow, the moisture control apparatus comprising:

a precooling coil in said return air flow for exchanging thermal energy between the return air flow and the cooling fluid;

a reheat coil in said supply air flow for exchanging thermal energy between the cooling fluid and the supply air flow;

a pump for motivating a flow of the cooling fluid through said precooling coil, said reheat coil, and said heat exchanger; and, a second fluid conduit for directing the cooling fluid through a series arrangement of said precooling coil, said heat exchanger, and said first conduit.

9. The moisture control apparatus according to claim 8 further comprising a regulator for regulating said cooling fluid flow through said precooling and reheat coil.

10. The moisture control apparatus according to claim 9 wherein said regulator comprises a control valve connected to said second fluid conduit in said series arrangement.

11. The moisture control apparatus according to claim 10 wherein said control valve comprises a first input port connected to said first fluid conduit for receiving a first flow of said cooling fluid from said water cooled air conditioning system, a second input port connected to said second conduit for selectively flow receiving and recirculating of said cooling fluid from said precooling coil, an output port connected to said second fluid conduit for exhausting said first and second flows from said control valve to said reheat coil, and a valve for selectively metering said first and second flows through said control valve as a metered flow.

12. The moisture control apparatus according to claim 11 wherein said pump comprises a variable speed drive fluid pump.

13. The moisture control apparatus according to claim 12 further comprising a controller operatively associated with said control valve and said variable speed drive fluid pump for sensing moisture in said supply air flow and for maintaining said sensed moisture at a predetermined set point by regulating i) said valve to selectively blend said first and second flows, and ii) said variable speed drive fluid pump to motivate the metered flow through said series combination of said reheat coil and said precooling coil.

14. The moisture control apparatus according to claim 13 further comprising a dry cooler connected to said first fluid conduit and operatively associated with said cooling fluid for exchanging thermal energy from cooling fluid with ambient air.

* * * * *